US011524305B2

(12) United States Patent
Lee et al.

(10) Patent No.: US 11,524,305 B2
(45) Date of Patent: Dec. 13, 2022

(54) ELECTROSTATIC PRECIPITATOR APPARATUS

(71) Applicant: DOOSAN ENERBILITY CO., LTD., Changwon-si (KR)

(72) Inventors: Jin Woon Lee, Gimhae-si (KR); Sang Rin Lee, Changwon-si (KR); Jae Dong Hwang, Gunsan-si (KR); Sang Chul Moon, Seoul (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 258 days.

(21) Appl. No.: 16/855,978

(22) Filed: Apr. 22, 2020

(65) Prior Publication Data

US 2020/0353480 A1 Nov. 12, 2020

(30) Foreign Application Priority Data

May 9, 2019 (KR) ..... 10-2019-0054387
May 22, 2019 (KR) ..... 10-2019-0060286

(51) Int. Cl.

*B03C 3/78* (2006.01)
*B03C 3/16* (2006.01)
*B03C 3/88* (2006.01)
*B03C 3/47* (2006.01)

(52) U.S. Cl.

CPC ..... *B03C 3/78* (2013.01); *B03C 3/16* (2013.01); *B03C 3/47* (2013.01); *B03C 3/88* (2013.01)

(58) Field of Classification Search

CPC combination set(s) only.
See application file for complete search history.

(56) References Cited

U.S. PATENT DOCUMENTS 2,100,155 A * 11/1937 Beran ..... B03C 3/53 261/119.1
2,486,877 A * 11/1949 Ransburg ..... B05B 14/42 261/80
2,964,126 A * 12/1960 Peterson ..... B03C 3/88 96/28

(Continued)

FOREIGN PATENT DOCUMENTS

CN 103785538 A 5/2014
CN 104129837 A 11/2014

(Continued)

OTHER PUBLICATIONS

CN OA dated Apr. 6, 2022.

*Primary Examiner* — Christopher P Jones
*Assistant Examiner* — Sonji Turner
(74) *Attorney, Agent, or Firm* — Harvest IP Law LLP

(57) ABSTRACT

Disclosed herein is an electrostatic precipitator apparatus that includes a housing having an inlet, into which gas is introduced, and an outlet from which the gas is discharged, and a collection module installed in the housing. The collection module includes a plurality of discharge electrodes, to which a voltage is applied, and a plurality of collection electrodes grounded and disposed between the discharge electrodes. The apparatus further comprises a washing water feeder to spray washing water to the collection module, and a washing water treatment device disposed beneath the collection module to accommodate the washing water dropped from the collection module.

14 Claims, 30 Drawing Sheets

(56) References Cited

U.S. PATENT DOCUMENTS

| | | | | | |
|---|---|---|---|---|---|
| 3,370,403 | A * | 2/1968 | D'Elia | ..... | B03C 3/16 261/80 |
| 3,891,414 | A * | 6/1975 | Snader | ..... | B03C 3/88 96/28 |
| 6,627,162 | B1 | 9/2003 | Chen | | |

FOREIGN PATENT DOCUMENTS

| | | | | | |
|---|---|---|---|---|---|
| CN | 108474253 | A | 8/2018 | | |
| DE | 102007036551 | A1 * | 2/2009 | ..... | B03C 3/145 |
| DE | 102009058208 | A1 * | 6/2011 | ..... | B03C 3/017 |
| JP | 59017389 | Y2 | 5/1984 | | |
| JP | H10-244183 | A | 9/1998 | | |
| JP | H11-047520 | A | 2/1999 | | |
| JP | 2003-290684 | A | 10/2003 | | |
| JP | 2009095799 | A | 5/2009 | | |
| JP | 2010-269248 | A | 12/2010 | | |
| JP | 2013-212455 | A | 10/2013 | | |
| JP | 2014-100642 | A | 6/2014 | | |
| KR | 1994-0007957 | B1 | 8/1994 | | |
| KR | 10-2011-0024429 | A | 3/2011 | | |
| KR | 10-1108123 | B1 | 1/2012 | | |
| KR | 10-2014-0047441 | A | 4/2014 | | |
| KR | 10-1387998 | B1 | 4/2014 | | |
| KR | 10-1478770 | B1 | 1/2015 | | |
| KR | 10-1610240 | B1 | 4/2016 | | |
| KR | 10-1679403 | B1 | 11/2016 | | |

* cited by examiner

ELECTROSTATIC PRECIPITATOR APPARATUS

CROSS-REFERENCE TO RELATED APPLICATION(S)

This application claims priority to Korean Patent Application No(s). 10-2019-0054387 and 10-2019-0060286, filed on May 9, 2019, and May 22, 2019 respectively, the disclosures of which are incorporated herein by reference in their entirety.

BACKGROUND

Technical Field

Exemplary embodiments relate to a wet electrostatic precipitator apparatus that collects dust by an electrostatic force and removes dust attached on collection electrodes by means of washing water.

Related Art

A variety of devices have been developed to remove particulate contaminants such as fine dust contained in the air. Among them, an electrostatic precipitator apparatus generates a large amount of electrons with corona discharge, in which case the generated electrons ionizes the surrounding air molecules. The air molecules ionized in the electrostatic precipitator apparatus are combined with particulates (e.g., fine dust, etc.) contained in the air so that the particulates are charged to have electrical polarity and then attached on collection electrodes by electrostatic force.

The electrostatic precipitator apparatus has a structure in which collection electrodes are electrically grounded and arranged at regular intervals and discharge electrodes, to which a high voltage is applied, are installed between the respective collection electrodes. When a high voltage is applied to each of the discharge electrodes, a corona discharge occurs between the discharge electrode and the collection electrode associated therewith. Both the collection electrode and the discharge electrode are typically made of an electrically conductive material.

Since the corona discharge occurs between the discharge electrode and the collection electrode, a lot of vibrations may occur in the discharge electrode and the collection electrode. In addition, increasing the distance between the discharge electrode and the collection electrode causes a deterioration in collection efficiency and requires that a large voltage is applied to the discharge electrode for the corona discharge. On the other hand, decreasing the distance between the discharge electrode and the collection electrode results in an improvement in collection efficiency. In this case, however, failure to securely support the discharge electrode and the collection electrode may result in a short circuit between the discharge electrode and the collection electrode.

In addition, washing water is utilized to remove foreign substances attached on the collection electrode. The immediate discharge of the spent washing water may result in waste of washing water and environmental pollution. In contrast, if the spent washing water is stored and then discharged, the washing water should be periodically discharged.

SUMMARY

Aspects of one or more exemplary embodiments provide an electrostatic precipitator apparatus that can efficiently manage washing water.

Aspects of one or more exemplary embodiments provide an electrostatic precipitator apparatus that can prevent damage to and reduce vibration of collection electrodes and discharge electrodes by maintaining a distance therebetween.

Additional aspects will be set forth in part in the description which follows and, in part, will become apparent from the description, or may be learned by practice of the exemplary embodiments.

According to an aspect of an exemplary embodiment, there is provided an electrostatic precipitator apparatus that includes a housing having an inlet, into which gas is introduced, and an outlet from which the gas is discharged, a collection module installed in the housing and including a plurality of discharge electrodes, to which a voltage is applied, and a plurality of collection electrodes disposed between the respective discharge electrodes, the collection electrodes being grounded, a washing water feeder configured to spray washing water to the collection module, and a washing water treatment device disposed beneath the collection module to accommodate the washing water dropping from the collection module. The washing water treatment device includes a reservoir configured to accommodate the washing water, an adsorption belt in an endless-track form, a roller connected to the adsorption belt to move the adsorption belt, and a scraper configured to scrape off dust attached on the adsorption belt to separate the scraped dust from the adsorption belt.

The adsorption belt may be in a mesh form.

A portion of the adsorption belt may be submerged in the washing water and the other portion of the adsorption belt may be positioned above the washing water.

The scraper may be installed vertically on the bottom of the reservoir and a mass of dust separated from the adsorption belt may be accumulated on the bottom of the reservoir.

The scraper may include a support rod installed vertically on the bottom of the reservoir and an elastic tip protruding upward from the support rod.

The adsorption belt may protrude outward from the housing, the scraper may be installed outside the housing, and a dust separation container may be installed beneath the scraper to accommodate the dust separated from the adsorption belt.

The housing may be provided therein with a blocking member configured to separate a space, in which the collection module is installed, from a space in which the washing water treatment device is installed. The blocking member may include a plurality of blocking plates and rotary columns coupled to the respective blocking plates, and may be rotatably installed in the housing.

The electrostatic precipitator apparatus may be a platform electrostatic precipitator apparatus installed between platforms, and guide vanes may be installed in the respective inlet and outlet to guide inflow and outflow of air.

The housing may be installed between two neighboring rails so that the air is introduced into and discharged from the housing by means of wind generated when a train moves.

The electrostatic precipitator apparatus may further include a controller connected to the guide vanes to control rotation of the guide vanes. When the train approaches toward the inlet, the controller may, based on the direction of movement of the train, control an outer end of the guide vane, installed in the inlet, to face rearward while controlling an outer end of the guide vane, installed in the outlet, to face forward.

The scraper may include a rotary rod and a plurality of paddles protruding from an outer peripheral surface of the rotary rod, the paddles being spaced apart from each other in a circumferential direction of the rotary rod.

The washing water treatment device may include two support rollers and first and second diversion rollers disposed between the support rollers, the first diversion roller being configured to support a lower end of the adsorption belt to move upward, the second division roller being configured to support the lower end of the adsorption belt to move downward. A blocking wall may be installed in the reservoir to separate a space, in which the scraper is present, from a remaining space.

The first diversion roller may support the adsorption belt to be positioned above an upper end of the blocking wall, and the second diversion roller may support the adsorption belt to be positioned beneath the upper end of the blocking wall.

The scraper may abut on the adsorption belt between the second diversion roller and an associated one of the support rollers.

According to an aspect of another exemplary embodiment, there is provided an electrostatic precipitator apparatus that includes a housing having an inlet, into which gas is introduced, and an outlet from which the gas is discharged, a collection module installed in the housing and including a plurality of discharge electrodes, to which a voltage is applied, and a plurality of collection electrodes disposed between the respective discharge electrodes, the collection electrodes being grounded, and a washing water feeder configured to spray washing water to the collection module, wherein the electrostatic precipitator apparatus is a platform electrostatic precipitator apparatus installed between platforms.

Guide vanes may be installed in the respective inlet and outlet to guide inflow and outflow of air.

The housing may be installed between two neighboring rails so that the air is introduced into and discharged from the housing by means of wind generated when a train moves.

The electrostatic precipitator apparatus may further include a controller connected to the guide vanes to control rotation of the guide vanes. When the train approaches toward the inlet, the controller may, based on the direction of movement of the train, control an outer end of the guide vane, installed in the inlet, to face rearward while controlling an outer end of the guide vane, installed in the outlet, to face forward.

According to an aspect of a further exemplary embodiment, there is provided an electrostatic precipitator apparatus that includes a housing having an inlet, into which gas is introduced, and an outlet from which the gas is discharged, a collection module installed in the housing and including a plurality of discharge electrodes, to which a voltage is applied, and a plurality of collection electrodes disposed between the respective discharge electrodes, the collection electrodes being grounded, a washing water feeder configured to spray washing water to the collection module, and a washing water treatment device disposed beneath the collection module to scrape off dust attached on an adsorption belt to separate the scraped dust from the adsorption belt, the adsorption belt being installed in a reservoir configured to accommodate the washing water dropping from the collection module.

The scraper may include a rotary rod and a plurality of paddles protruding from an outer peripheral surface of the rotary rod, the paddles being spaced apart from each other in a circumferential direction of the rotary rod.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
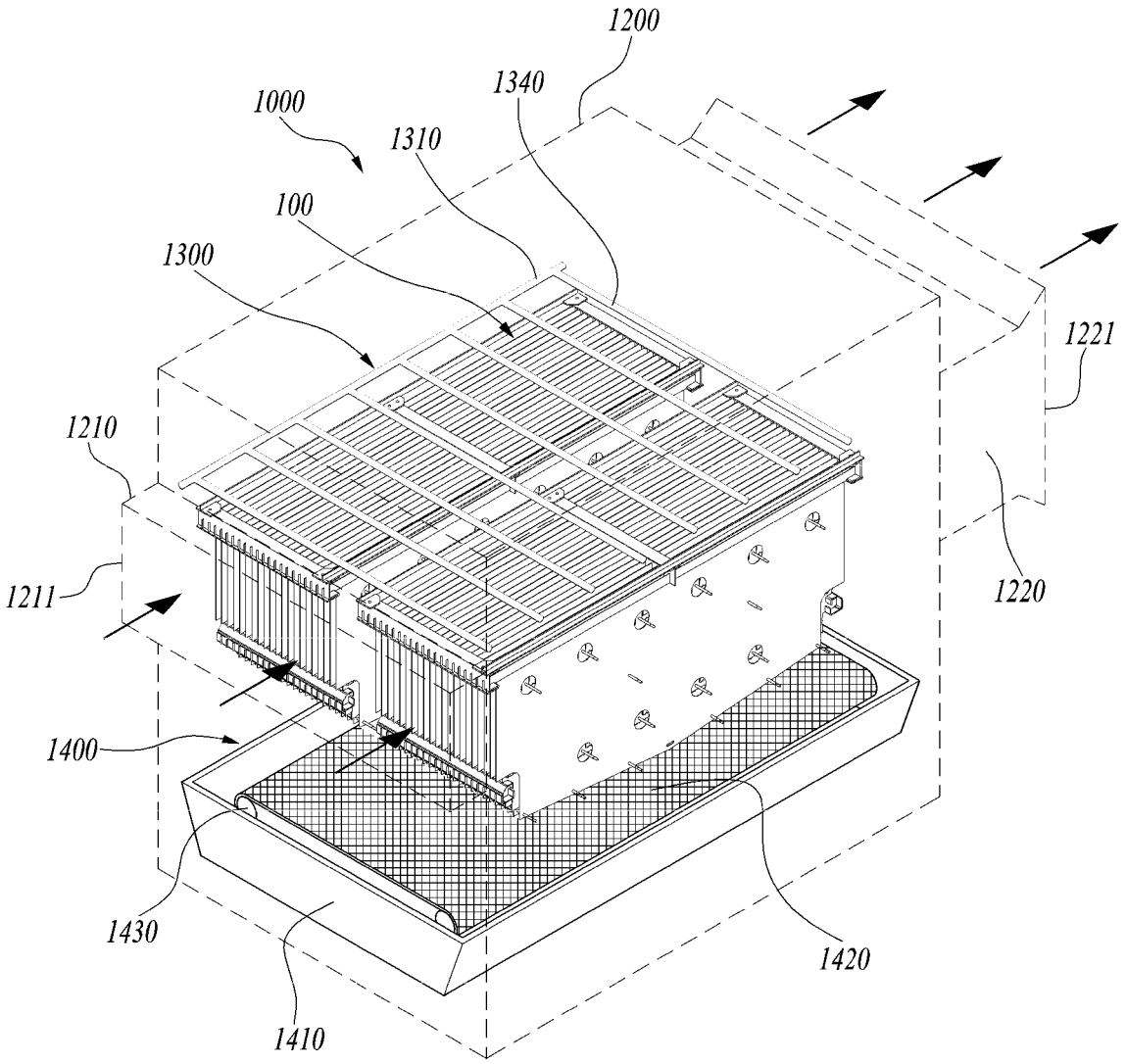
FIG. 1 is a perspective view illustrating an electrostatic precipitator apparatus according to a first exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. Throughout the disclosure, like reference numerals refer to like parts throughout the various figures and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
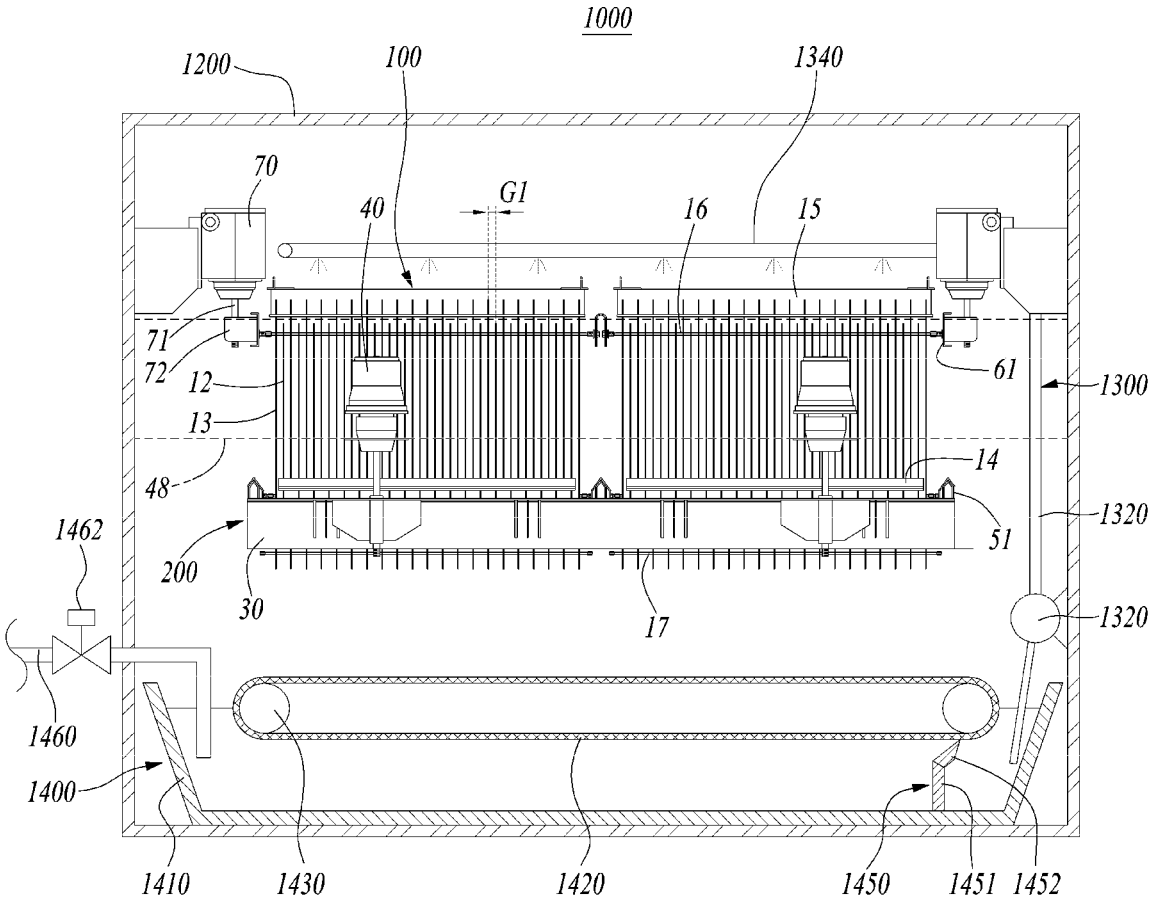
FIG. 2 is a cross-sectional view illustrating the electrostatic precipitator apparatus according to the first exemplary embodiment.

Hereinafter, an electrostatic precipitator apparatus according to a first exemplary embodiment will be described. FIG. 1 is a perspective view illustrating the electrostatic precipitator apparatus according to the first exemplary embodiment. FIG. 2 is a cross-sectional view illustrating the electrostatic precipitator apparatus according to the first exemplary embodiment.

Referring to FIGS. 1 and 2, the electrostatic precipitator apparatus, which is designated by reference numeral 1000, according to the first exemplary embodiment is a general-purpose electrostatic precipitator apparatus that includes discharge electrodes 12 and collection electrodes 13, which may be used for plants, buildings, homes, and so on. In addition, the electrostatic precipitator apparatus 1000 according to the first exemplary embodiment may be a wet electrostatic precipitator apparatus that cleans collection electrodes 13 by means of washing water.

The electrostatic precipitator apparatus 1000 may include a housing 1200, collection modules 100, a washing water feeder 1300, and a washing water treatment device 1400. The housing 1200 is of a substantially rectangular box shape that has an internal space. However, the present disclosure is not limited thereto, and the housing may be one of various shapes, such as a cylinder and a hexagonal column.

The housing 1200 may have an inlet duct 1210 formed on one side thereof and an outlet duct 1220 formed on the other side thereof opposite to the inlet duct 1210. The inlet duct 1210 is provided with an inlet 1211 for introduction of air or combustion gas, and the outlet duct 1220 is provided with an outlet 1221 for discharge of air or combustion gas.

Figure 3:
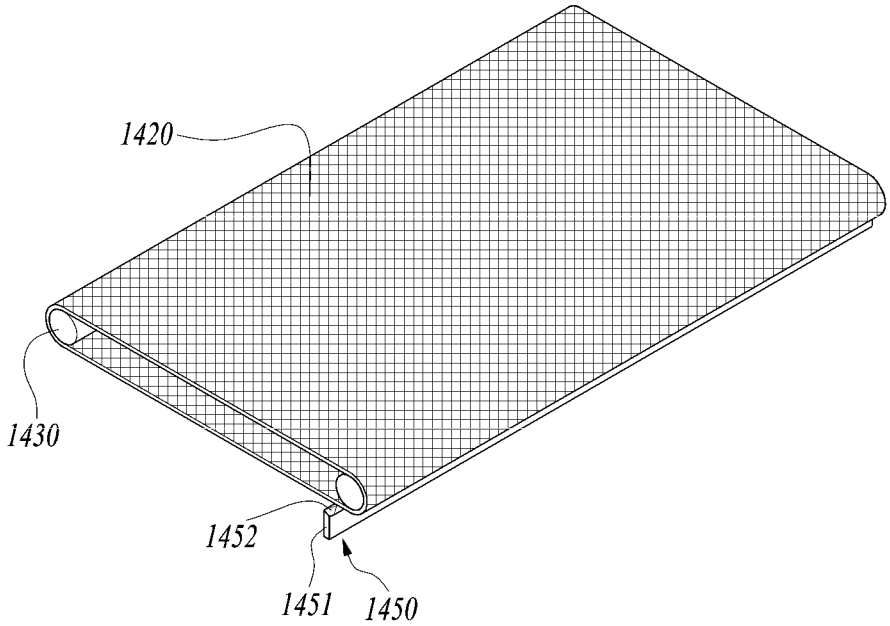
FIG. 3 is a perspective view illustrating an adsorption belt and rollers according to the first exemplary embodiment.

FIG. 3 is a perspective view illustrating an adsorption belt and rollers according to the first exemplary embodiment.

Referring to FIGS. 1 to 3, the washing water feeder 1300 includes a washing water supply line 1310, a pump 1320, and a spray line 1340. The washing water supply line 1310 is a pipe, which is inserted into a reservoir 1410 disposed on the bottom of the housing 1200 and extends from the reservoir 1410 to the top of the housing 1200. The pump 1320 is connected to the washing water supply line 1310 to move washing water. The spray line 1340 is installed above the collection modules 100 to spray washing water toward the collection modules 100. The spray line 1340 may be provided with a nozzle and may extend in the stacking direction of the discharge and collection electrodes 12 and 13. The washing water feeder 1300 may operate intermittently, for example, for a few minutes every few hours. When washing water is supplied, no voltage is applied to the discharge electrodes 12.

The washing water treatment device 1400 accommodates washing water dropped from the collection modules 100 and solidifies dust contained in the washing water. The washing water treatment device 1400 may include the reservoir 1410 configured to store washing water, an adsorption belt 1420 installed at the upper portion of the reservoir 1410, rollers 1430 configured to move the adsorption belt 1420, and a scraper 1450 configured to separate the dust attached on the adsorption belt 1420. Here, the washing water may be water or an aqueous sodium hydroxide solution.

When the aqueous sodium hydroxide solution is used as the washing water, the washing capability of the washing water treatment device can be improved.

The reservoir 1410 is disposed on the bottom of the housing 1200 and stores the washing water supplied through the washing water feeder 1300 therein. The reservoir 1410 may be connected to a washing water replenishment line 1460 for replenishment of washing water, and the washing water replenishment line 1460 may have a valve 1462 installed therein.

The adsorption belt 1420 may be in a mesh form, and be made of porous metal or resin. When the adsorption belt 1420 is in the mesh form, the dust contained in the washing water may be attached on the adsorption belt 1420 and the washing water may flow into the reservoir through the adsorption belt 1420.

The adsorption belt 1420 is in an endless-track form that its longitudinal ends are connected to each other. The lower portion of the adsorption belt 1420 is submerged in the washing water and the upper portion of the adsorption belt 1420 is positioned above the washing water for exposure out of the washing water. That is, in the annular adsorption belt 1420 that is flat in longitudinal section, its lower vertical center may be submerged in the washing water and its upper vertical center may be positioned above the washing water. The adsorption belt 1420 has a flat upper surface positioned above the washing water, a flat lower surface submerged in the washing water, and curved side surfaces connecting the upper surface and the lower surface.

During the operation of the adsorption belt 1420, the lower portion of the adsorption belt 1420 adsorbs the dust in the washing water and the upper portion thereof adsorbs the dust contained in the dropping washing water.

The two rollers 1430 support both longitudinal ends of the adsorption belt 1420. A motor for rotating the rollers 1430 is connected to the rollers 1430 to move the adsorption belt 1420. The rollers 1430 may be intermittently operated only when washing water is supplied.

The scraper 1450 abuts on the lower portion of the adsorption belt 1420 to scrape off the dust attached on the adsorption belt 1420 to separate the dust from the adsorption belt 1420. The scraper 1450 may include a support rod 1451 and a tip 1452 fixed on the support rod 1451. The support rod 1451 is installed vertically and fixedly on the bottom of the reservoir 1410. The tip 1452 may be inclined relative to the support rod 1451 while protruding upward, and be made of an elastic material. The mass of dust separated by the scraper 1450 is solidified and accumulated on the bottom of the reservoir 1410 so that relatively clean washing water is present at the upper portion of the reservoir 1410. Such upper washing water may be supplied to the washing water feeder 1300 for use for further washing.

Thus, according to the first exemplary embodiment, the washing water stored in the reservoir 1410 can be used for a predetermined period without being discharged. In addition, when the washing water needs to be replaced, a worker can remove the mass of dust from the bottom of the reservoir 1410 and replace the washing water.

As described above, according to the first exemplary embodiment, since the mass of dust sinks to the bottom of the reservoir 1410, it may be possible to purify the washing water and thus increase the service life of the washing water.

Figure 4:
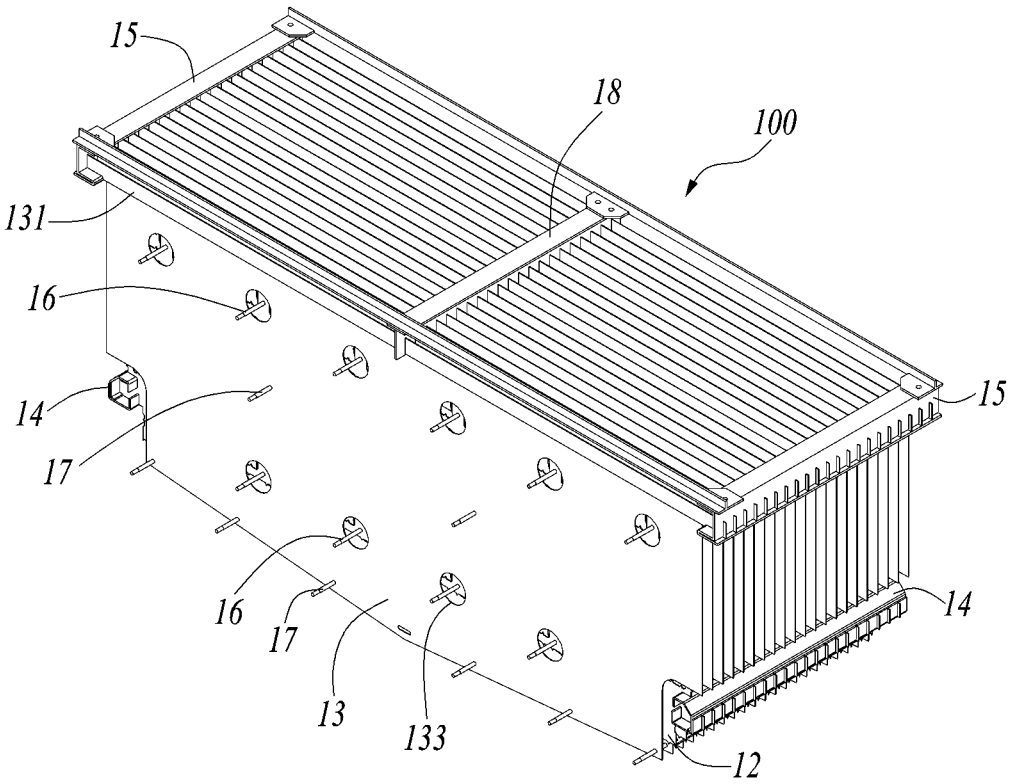
FIG. 4 is a perspective view illustrating one collection module according to the first exemplary embodiment.
Figure 5:
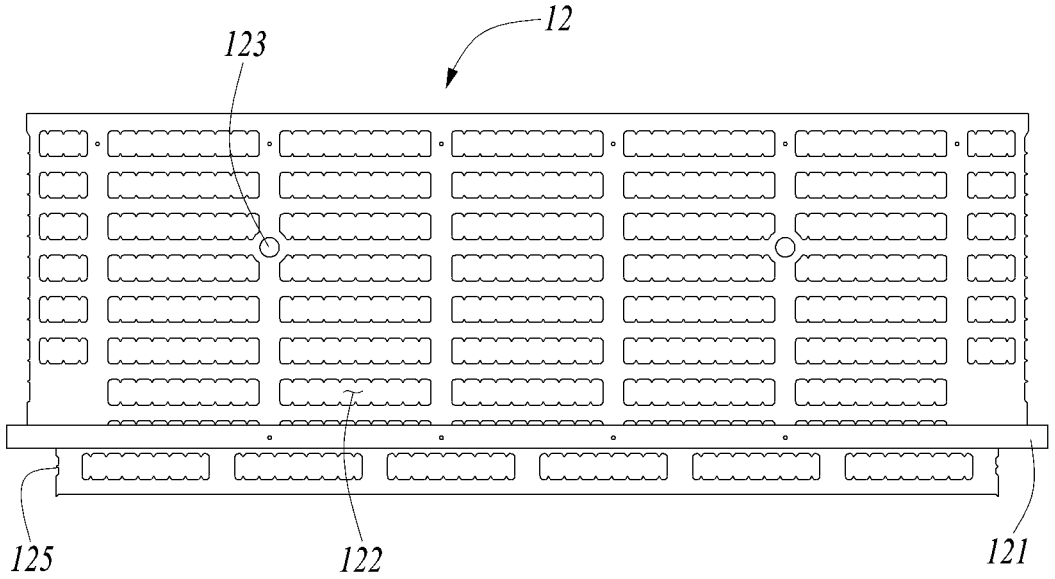
FIG. 5 is a front view illustrating one discharge electrode according to the first exemplary embodiment.
Figure 6:
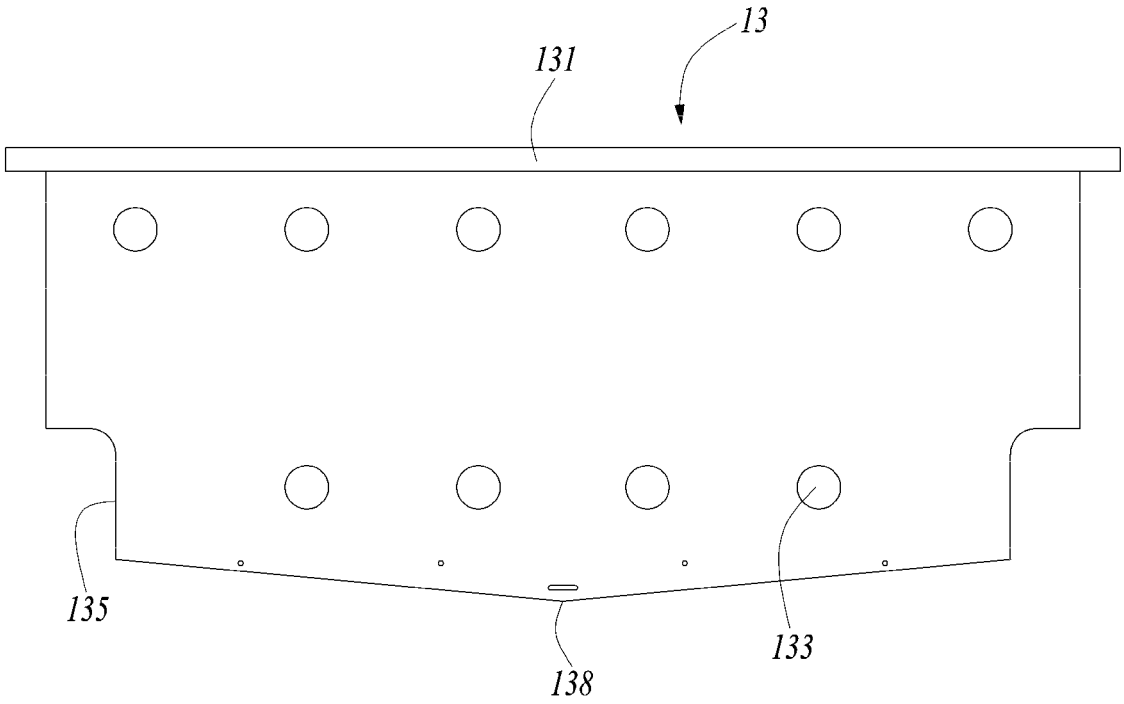
FIG. 6 is a front view illustrating one collection electrode according to the first exemplary embodiment.

FIG. 4 is a perspective view illustrating one collection module according to the first exemplary embodiment. FIG. 5 is a front view illustrating one discharge electrode according to the first exemplary embodiment. FIG. 6 is a front view illustrating one collection electrode according to the first exemplary embodiment.

Referring to FIGS. 4 to 6, each of the collection modules 100 includes discharge electrodes 12, collection electrodes 13, first tie rods 16, second tie rods 17, first setting beams 14, second setting beams 15, and a central setting beam 18. The collection module 100 may be installed inside the housing 1200 through a frame assembly in the state in which the collection module 100 is fixed by the tie rods 16 and 17 and the setting beams 14, 15, and 18.

Each of the discharge electrodes 12 has a flat plate shape and has a plurality of openings 122. The openings 122 may each be of a square shape, and the discharge electrode 12 has a plurality of discharge pins formed at the edges thereof. The discharge pins may each be in a needle form and may be spaced apart from each other along the outer end and openings 122 of the discharge electrode 12.

The discharge electrode 12 includes a first reinforcement rod 121 installed at the lower portion thereof, and the first reinforcement rod 121 is coupled to the first setting beams 14 to support the discharge electrode 12. The first reinforcement rod 121 is longer than the width of the discharge electrode 12 so as to protrude from both side ends of the discharge electrode 12. In addition, the discharge electrode 12 may have a plurality of first holes 123 through which the second tie rods 17 pass.

The discharge electrode 12 has cut grooves 125 formed on both lower portions thereof for installation of the first setting beams 14. The first reinforcement rod 121 together with the upper ends of the cut grooves 125 are inserted into and fixed by the first setting beams 14.

Each of the collection electrodes 13 is formed of a flat plate and has a plurality of second holes 133 through which the first tie rods 16 pass. The collection electrode 13 includes a second reinforcement rod 131 disposed at the upper portion thereof to support the collection electrode 13. The second reinforcement rod 131 is longer than the width of the collection electrode 13 so as to protrude from both side ends of the collection electrode 13.

The plurality of discharge electrodes 12 and collection electrodes 13 are arranged in parallel to each other, and the discharge electrodes 12 are equally disposed between the respective collection electrodes 13. A gap G1 between each of the collection electrodes 13 and the discharge electrode 12 adjacent thereto may be 50 to 70 mm.

The collection electrode 13 has avoidance grooves 135 formed on both side ends of the lower portion thereof, and the first setting beams 14 are installed to pass through portions where the avoidance grooves 135 are formed. The upper ends of the avoidance grooves 135 may be formed above the associated first reinforcement rod to prevent the short circuit of the collection electrode 13 to the discharge electrode 12.

When a high voltage is applied to the discharge electrode 12, a corona discharge occurs between the discharge electrode 12 and the collection electrode 13 to generate an electrostatic force. Particulates are charged by combining them with ions (e.g., electrons) generated during the corona discharge while gas moves to the region where the electrostatic force is generated with the corona discharge, and then the charged particulates are attached on the collection electrode 13 by the electrostatic force.

Meanwhile, the collection electrode 13 may have a lower end inclined relative to the ground, and have the lowest end 138 of the inclined lower end. The lowest end 138 may be at the center of the collection electrode 13 or at one widthwise side of the collection electrode 13.

The lower end 134 of the collection electrode 13 is inclined downward toward the widthwise center thereof from both side ends thereof while being inclined relative to the ground. Thus, the central portion of the collection electrode 13 is positioned lower than both side ends thereof so that the washing water flowing along the surface of the collection electrode 13 is collected at the lowest end 138 of the central portion of the collection electrode 13 along the lower end of the collection electrode 13.

Each of the first tie rods 16 is fitted to the plurality of discharge electrodes 12 through the associated second holes 133 formed in the collection electrodes 13, in which case the first tie rod 16 does not come into contact with the collection electrodes 13. Some of the first tie rods 16 are coupled to the upper portion of each discharge electrode 12 and the other first tie rods 16 are coupled to the lower portion of each discharge electrode 12.

The first tie rods 16 may each have threads formed on the longitudinal ends thereof. Lower ones of the first tie rods 16 are fixed to lower support beams 51 and upper ones of the first tie rods 16 are fixed to upper support beams 61.

On the other hand, each of the second tie rods 17 is fitted to the plurality of collection electrodes 13 through the associated first holes 123 formed in the discharge electrodes 12, in which case the second tie rod 17 does not come into contact with the discharge electrodes 12.

Some of the second tie rods 17 are coupled to the upper portion of each collection electrode 13 and the other second tie rods 17 are coupled to the lower portion of each collection electrode 13. The longitudinal ends of each second tie rod 17 may be fixed to the associated collection electrodes 13, but the present disclosure is not limited thereto. For example, the second tie rod 17 may be fixed to other members within the housing 1200.

The first and second tie rods 16 and 17 may have spacers installed to maintain the distance between the discharge electrode 12 and the collection electrode 13. That is, the spacer installed on the first tie rod 16 may pass through an associated second hole 133 of each collection electrode 13 so that both longitudinal ends of the spacer abut on the facing surfaces of the discharge electrodes 12 adjacent to the collection electrode 13. In addition, the spacer installed on the second tie rod 17 may pass through an associated first hole 123 of each discharge electrode 12 so that both longitudinal ends of the spacer abut on the facing surfaces of the collection electrodes 13 adjacent to the discharge electrode 12.

Figure 7:
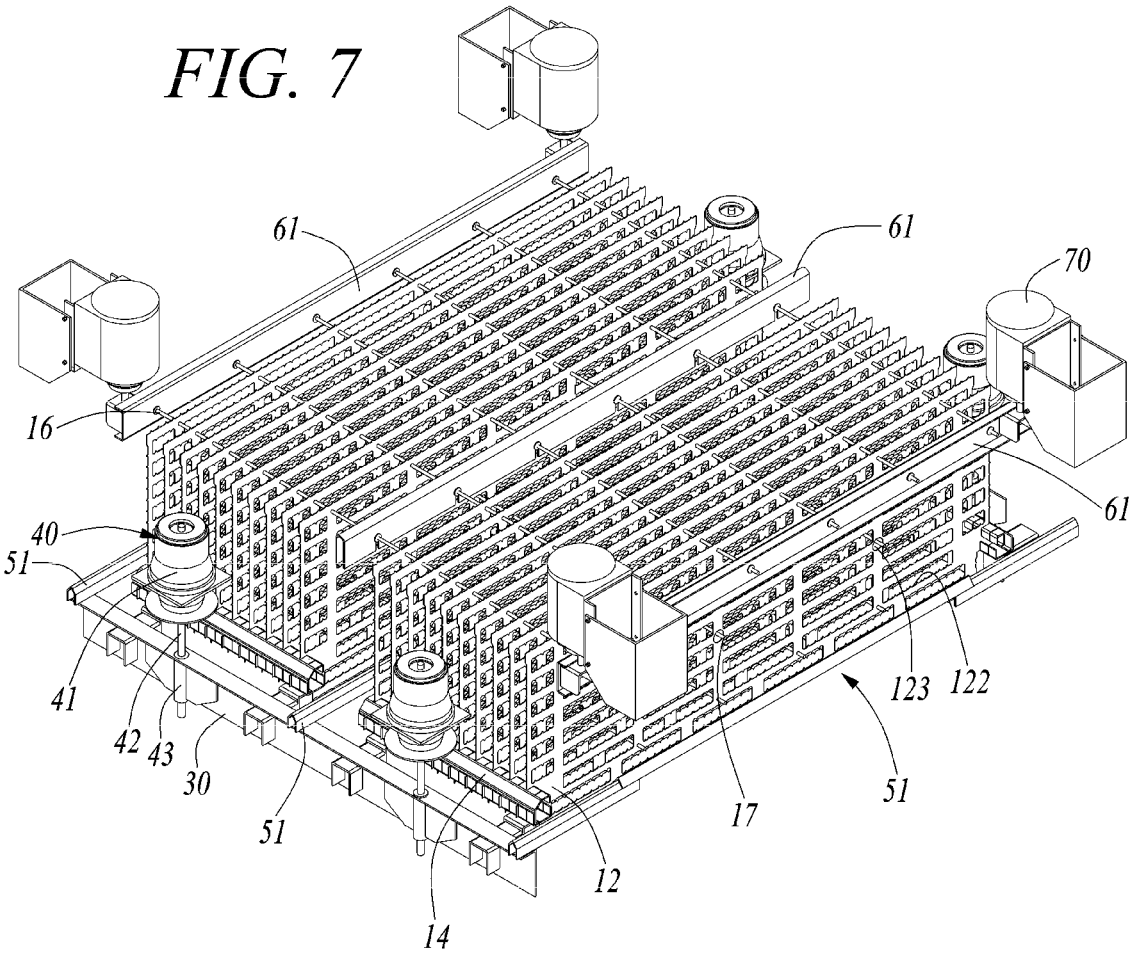
FIG. 7 is a perspective view illustrating the discharge electrodes and supports in the collection modules, and a frame assembly according to the first exemplary embodiment.
Figure 8:
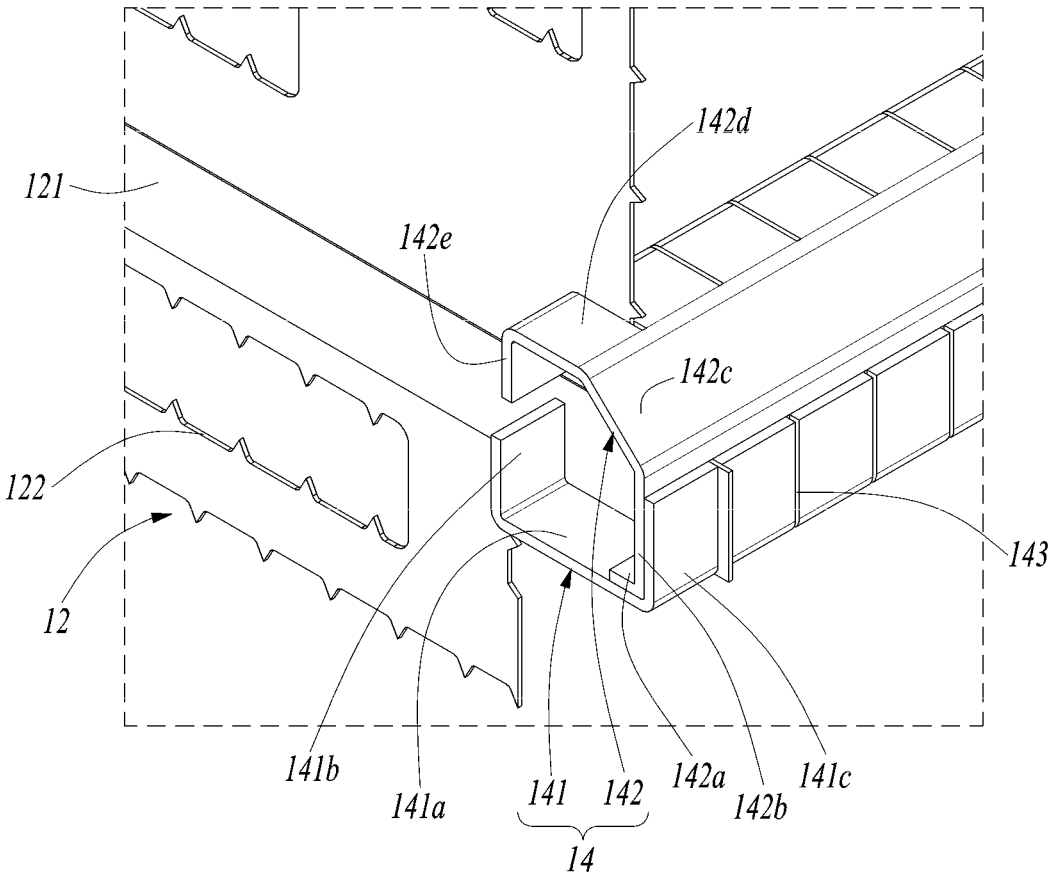
FIG. 8 is a view illustrating a state in which the discharge electrode is supported by one first setting beam according to the first exemplary embodiment.
Figure 9:
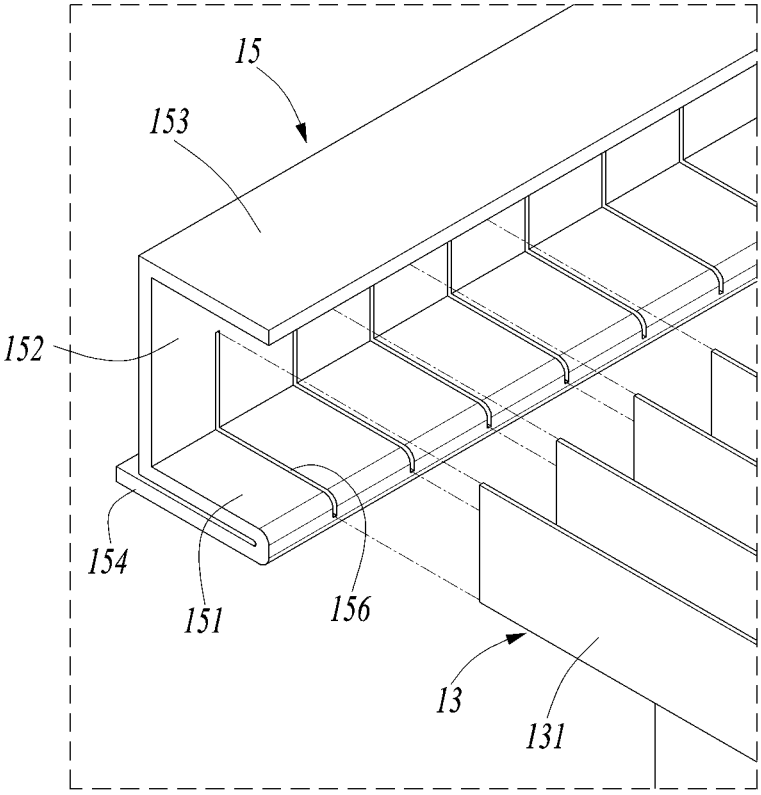
FIG. 9 is a view illustrating a state in which the collection electrodes are supported by one second setting beam according to the first exemplary embodiment.

FIG. 7 is a perspective view illustrating the discharge electrodes and supports in the collection modules, and the frame assembly according to the first exemplary embodiment. FIG. 8 is a view illustrating a state in which the discharge electrode is supported by a first setting beam according to the first exemplary embodiment. FIG. 9 is a view illustrating a state in which the collection electrodes are supported by a second setting beam according to the first exemplary embodiment.

Referring to FIGS. 7 to 9, each of the first setting beams 14 extends in the stacking direction of the discharge electrodes 12, and has a plurality of lower slots 143 into which the side ends of the respective discharge electrodes 12 are inserted. The first reinforcement rod 121 of each discharge electrode 12 is inserted into the first setting beam 14. The first reinforcement rod 121 is installed to pass through the first setting beam 14, and the lower end of the first reinforcement rod 121 is supported by the bottom of the first setting beam 14.

The first setting beam 14 may include a lower beam 141 and an upper beam 142 coupled to the lower beam 141. The lower beam 141 includes a bottom 141*a* and two sidewalls 141*b* and 141*c* bent and protruding upward from both side ends of the bottom 141*a*. The upper beam 142 includes a lower support 142*a* abutting on the bottom 141*a*, an outer support 142*b* bent from the lower support 142*a* and abutting on an outer one 141*c* of the sidewalls, an inclined support 142*c* bent obliquely upward from the outer support 142*b*, an upper support 142*d* bent from the inclined support 142*c* and disposed in parallel to the bottom 141*a*, and an inner support 142*e* bent and extending downward from the upper support 142*d*. The moisture remaining on the first setting beam 14 may be easily discharged to outside through the inclined support 142*c*.

The lower slots 143 are formed on the sidewalls 141*b* and 141*c* and are not formed on the bottom 141*a*. In addition, the lower slots 143 are also formed on the upper beam 142, namely, on the lower support 142*a* and the outer support 142*b*. Individual ones of the lower slots 143 formed on the lower beam 141 are connected to associated ones of the lower slots 143 formed on the upper beam 142. Each of the first reinforcement rod 121 protrudes through the associated lower slots 143 formed on the sidewalls 141*b* and 141*c* and the associated lower slot 143 formed on the outer support 142*b*.

When the upper beam 142 and the lower beam 141 are coupled to each other, the first setting beam 14 has a tubular shape that is cut off at its one side. When the first setting beam 14 is separated into the upper beam 142 and the lower beam 141 as described above, the discharge electrode 12 may be easily welded to the lower beam 141. That is, when, after the discharge electrode 12 is welded to the lower beam 141, the upper beam 142 is coupled to the lower beam 141 and the discharge electrode 12 is welded to the upper beam 142, the discharge electrode 12 may be stably fixed to the first setting beam 14 while the first setting beam 14 is formed in a tubular shape.

The first reinforcement rod 121 may be made of the same material as the first setting beam 14 and may be thicker than the discharge electrode 12. Thus, the first reinforcement rod 121 may be easily welded to the first setting beam 14. The discharge electrode 12 should have a small thickness and an excellent electrical conductivity, but it may be difficult to weld the discharge electrode high in conductivity and thin in thickness. However, according to the first exemplary embodiment, the discharge electrode 12 can be easily welded to the first setting beam 14 since the discharge electrode 12 includes the first reinforcement rod 121.

Each of the second setting beams 15 extends in the stacking direction of the collection electrodes 13, and has a plurality of upper slots 156 into which the side ends of the respective collection electrodes 13 are inserted. The upper slots 156 may be spaced apart from each other in the longitudinal direction of the second setting beam 15, and the second setting beam 15 may be positioned above the first setting beam 14. Meanwhile, as illustrated in FIG. 4, a central setting beam 18 is installed on the upper widthwise centers of the collection electrodes 13, and has a plurality of "T"-shaped slots into which the upper centers of the respective collection electrodes 13 are inserted.

The second reinforcement rod 131 is fixed to the upper end of each collection electrode 13, and is inserted into the second setting beam 15. The second reinforcement rod 131 is installed to pass through the second setting beam 15, and the lower end of the second reinforcement rod 131 is supported by the second setting beam 15.

The second setting beam 15 includes a lower plate 151, a side plate 152 bent and extending upward from the lower plate 151, an upper plate 153 bent from the side plate 152 to face the lower plate 151, and a support plate 154 disposed beneath the lower plate 151. The second reinforcement rod 131 is partially inserted into the lower plate 151 and the side plate 152, and the lower end of the second reinforcement rod 131 abuts on the upper surface of the support plate 154. The second reinforcement rod 131 may be fixed to the second setting beam 15 by welding.

As described above, in the collection module 100 according to the first exemplary embodiment, the first and second tie rods 16 and 17, the first and second setting beams 14 and 15, and the central setting beam 18 may stably fix the discharge and collection electrodes 12 and 13 while maintaining the distance therebetween.

Figure 10:
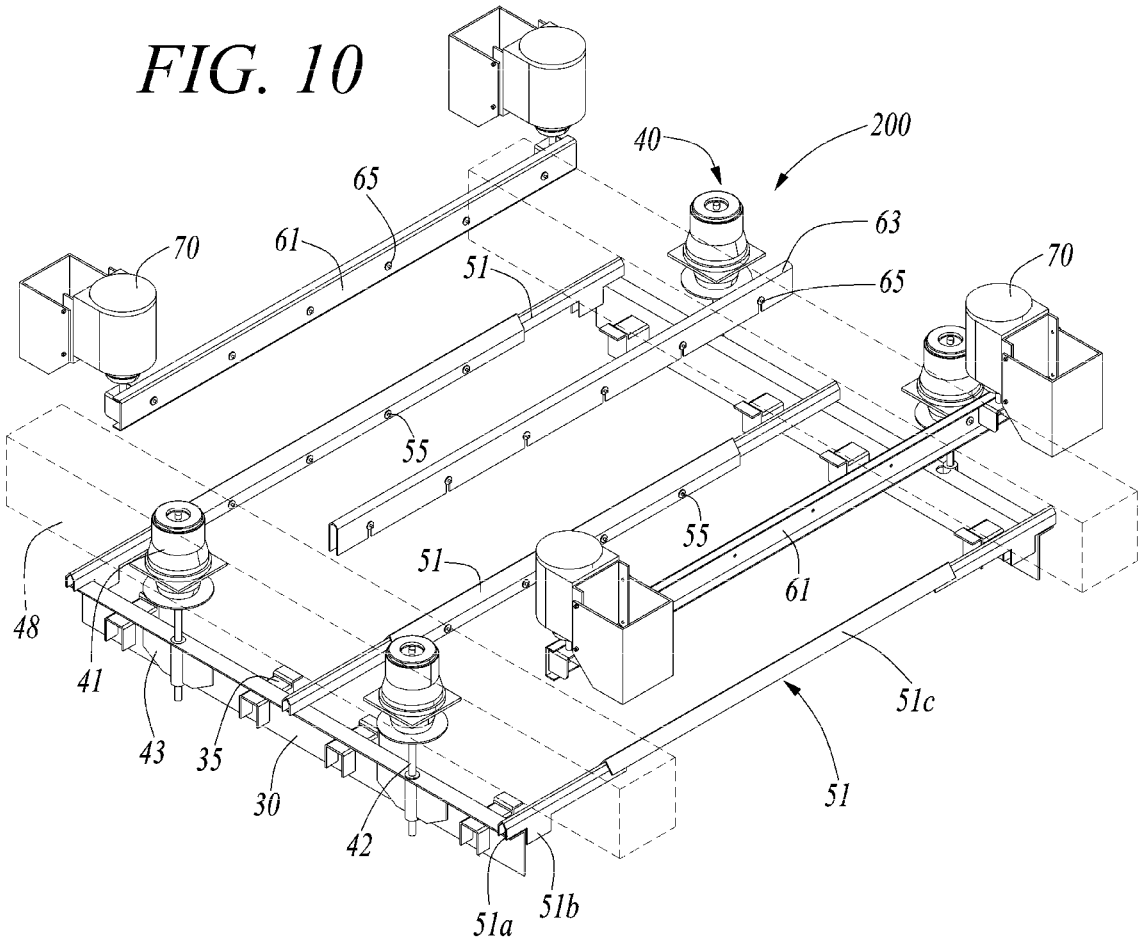
FIG. 10 is a perspective view illustrating the frame assembly according to the first exemplary embodiment.
Figure 11:
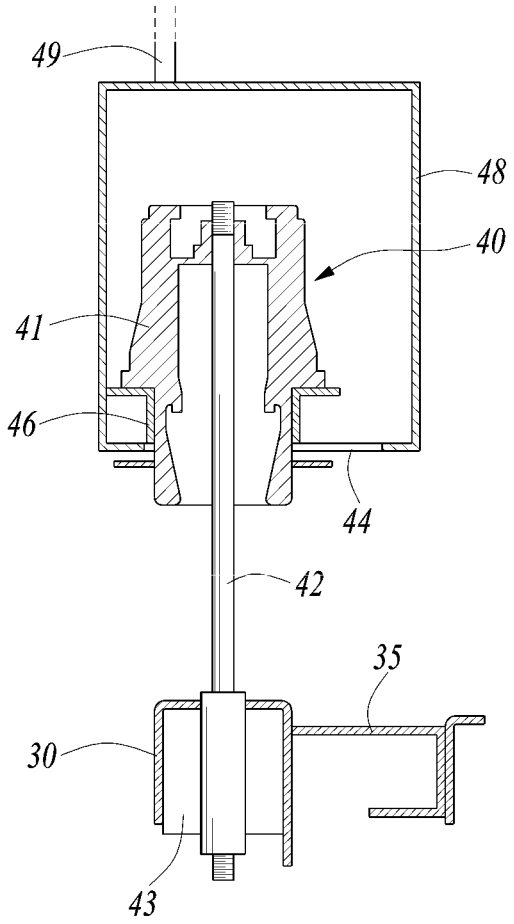
FIG. 11 is a cross-sectional view illustrating one insulating connection member and one lower frame according to the first exemplary embodiment.

FIG. 10 is a perspective view illustrating the frame assembly according to the first exemplary embodiment. FIG. 11 is a cross-sectional view illustrating one insulating connection member and one lower frame according to the first exemplary embodiment.

Referring to FIGS. 10 and 11, the electrostatic precipitator apparatus 1000 according to the present embodiment may further include a frame assembly 200, and the frame assembly 200 may include lower frames 30, tubular girders 48, outer upper support beams 61, lower support beams 51, prestress locking members 70, and insulating connection members 40.

Each of the lower frames 30 extends in the stacking direction of the discharge and collection electrodes 12 and 13, and is supported by the insulating connection members 40. Two of the lower frames 30 are disposed in parallel to each other, and two insulating connection members 40 are installed to each of the lower frames 30. The lower frame 30 has a plurality of mounts 35 protruding laterally therefrom, and the associated first setting beam 14 is mounted on the mounts 35. The lower frame 30 is charged to a high voltage, and the first setting beam 14 and the discharge electrode 12 are also charged to a high voltage through the lower frame 30.

The lower support beams 51 extend between the two lower frames 30 and are mounted on the lower frames 30. The lower support beams 51 are disposed at the outsides of the collection modules 100 and at the center between the collection modules 100, respectively. Each of the lower support beams 51 includes side protrusions 51*a* positioned on the lower frames 30, lower protrusions 51*b* protruding downward to abut on the sides of the lower frames 30, and a support bar 51*c* to which the first tie rods 16 are fixed.

The lower support beam 51 is provided with a plurality of connectors 55 to which the first tie rods 16 are coupled, and the connectors 55 are screwed to the first tie rods 16 to fix the first tie rods 16. One longitudinal end of each first tie rod 16 is fixed to an associated one of the outer lower support beams 51 and the other longitudinal end thereof is fixed to the central lower support beam 51.

As described above, according to the first exemplary embodiment, the collection module 100 can be easily fixed to the frame assembly 200 by fastening the first tie rods 16 to the lower support beams.

Meanwhile, the insulating connection members 40 are installed to the lower frames 30. Each of the insulating connection members 40 includes a high-voltage terminal rod 42 configured to apply a high voltage to the discharge electrode 12, and a lower insulator 41 for insulation. The insulating connection member 40 may have a hole formed in the lower portion thereof for downward injection of air, and the high-voltage terminal rod 42 is fixed to the associated lower frame 30 by protruding downward through the hole. An anchor 43 is installed to the high-voltage terminal rod 42 to support the lower frame 30.

Thus, a high voltage is applied to the discharge electrode 12 through the lower frame 30 and the first setting beam 14. In addition, the lower frame 30 is suspended from the insulating connection member 40.

The insulating connection members 40 are inserted into the tubular girders 48 each having an internal space, and the tubular girders 48 extend in the same direction as the lower frames 30. The tubular girders 48 may be fixed to the inner wall of the housing 1200, and a purge air supply pipe 49 may be installed on each of the tubular girders 48. The tubular girder 48 may have a discharge hole 44 formed in the lower portion thereof for discharge of purge air.

The tubular girder 48 has a mount 46 installed therein to support the lower insulator 41, and the lower insulator 41 is placed on the mount 46. A power supply is connected to the insulating connection member 40 to apply a high voltage thereto, and the high-voltage terminal rod 42 is insulated and fixed to the tubular girder 48 through the lower insulator 41. The high-voltage terminal rod 42 may pass through the center of the lower insulator 41, and a power supply line may be connected to the upper end of the high-voltage terminal rod 42. Thus, the high-voltage terminal rod 42 may be charged to a high voltage and the tubular girder 48 may be grounded.

The second setting beam 15 may be fixed on the upper surface of the tubular girder 48 and the lower end of the second setting beam 15 may be fixed to the tubular girder 48 by welding or the like. The second setting beam 15 extends in the same direction as the longitudinal direction of the tubular girder 48.

Figure 12:
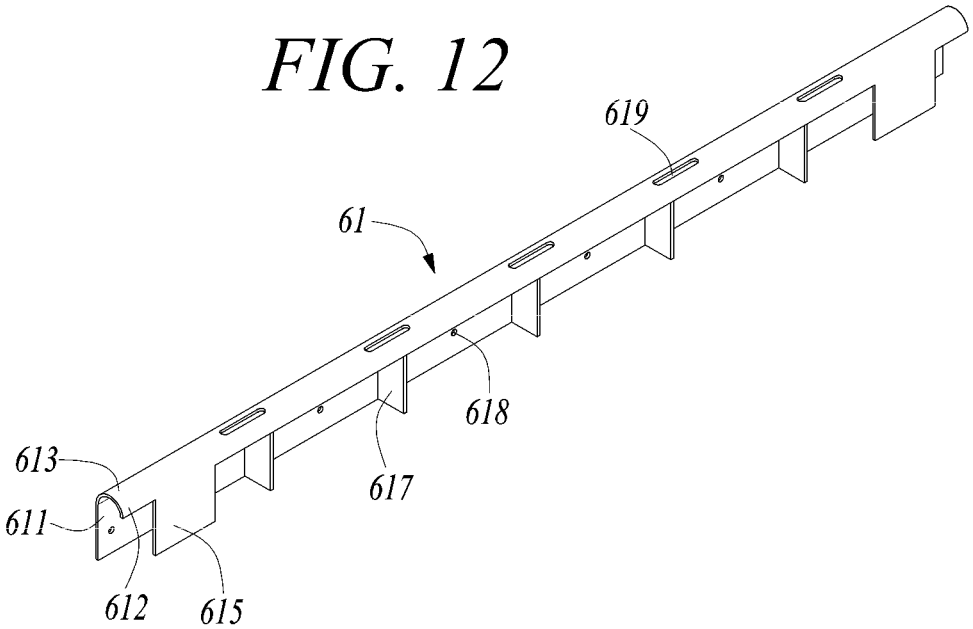
FIG. 12 is a perspective view illustrating one outer upper support beam according to the first exemplary embodiment.
Figure 13:
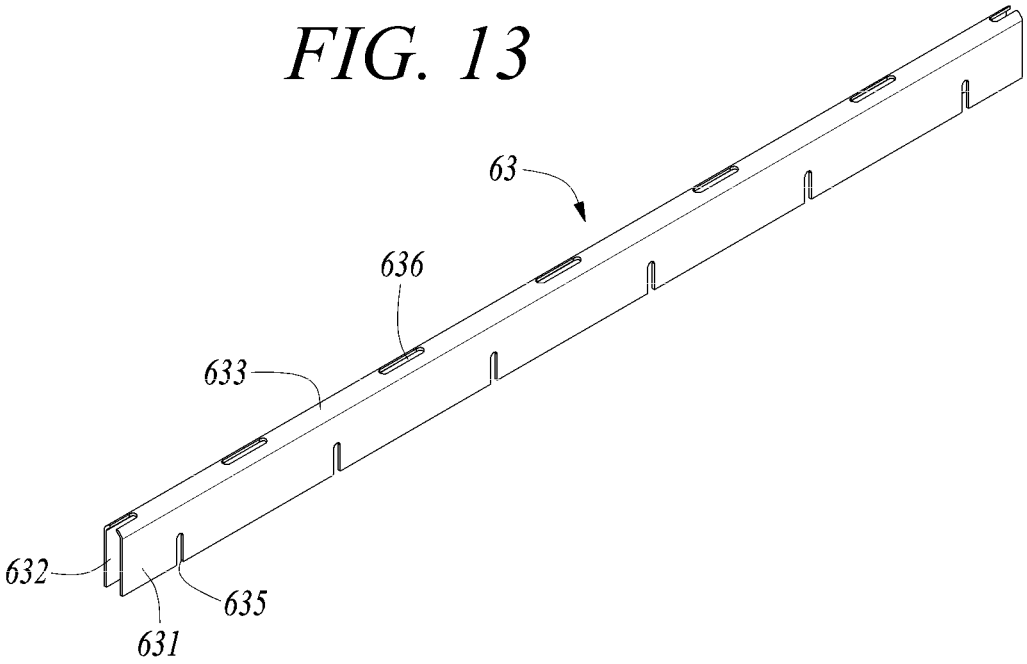
FIG. 13 is a perspective view illustrating a central upper support beam according to the first exemplary embodiment.

FIG. 12 is a perspective view illustrating one outer upper support beam according to the first exemplary embodiment. FIG. 13 is a perspective view illustrating a central upper support beam according to the first exemplary embodiment.

Referring to FIGS. 12 and 13, the outer upper support beams 61 are disposed above the collection modules 100 and are disposed on both outer sides of the collection modules 100, respectively. The central upper support beam, which is designated by reference numeral 63, is disposed between the outer upper support beams 61 and at the upper center between the collection modules 100.

Each of the outer upper support beams 61 and the central upper support beam 63 is provided with a plurality of connectors 65 (see FIG. 10) to which the first tie rods 16 are coupled, and the connectors 65 are screwed to the first tie rods 16 to fix the first tie rods 16. One longitudinal end of each first tie rod 16 is fixed to an associated one of the outer upper support beams 61 and the other longitudinal end thereof is fixed to the central upper support beam 63.

Each of the outer upper support beams 61 includes front and back plates 611 and 612 facing each other, and a support plate 613 connecting the front plate 611 to the back plate 612. The front and back plates 611 and 612 may each be a flat plate and the support plate 613 may be a curved plate. The support plate 613 has a plurality of holes 619 formed for discharge of washing water. The front plate 611 may have holes 618 formed for coupling with the connectors.

The back plate 612 has a height smaller than the front plate 611, and coupling plates 615 protrude downward from the back plate 612 so that the prestress locking members 70 are coupled to the coupling plates 615. The coupling plates 615 are positioned at both longitudinal edges of the outer upper support beam 61.

The outer upper support beam 61 further includes reinforcement ribs 617, which are positioned between the front plate 611 and the back plate 612 and abut on and support the inner surfaces of the front and back plates 611 and 612. The reinforcement ribs 617 are spaced apart from each other in the longitudinal direction of the outer upper support beam 61.

Meanwhile, the central upper support beam 63 includes two wall surfaces 631 and 632 extending downward, and a support surface 633 which connects the wall surfaces 631 and 632 and is curved. The wall surfaces 631 and 632 may each have a plurality of grooves 635 into which the connectors 65 are inserted, and the support surface 633 may have a plurality of holes 636 formed for discharge of washing water.

The prestress locking members 70 are connected to the outer upper support beam 61 to press and support the outer upper support beam 61. In order to reduce the vibration of the collection module 100, the prestress locking members 70 are fixedly installed in the state in which a pressing force is applied to the outer upper support beam 61 to press the outer upper support beam 61 inward.

Figure 14:
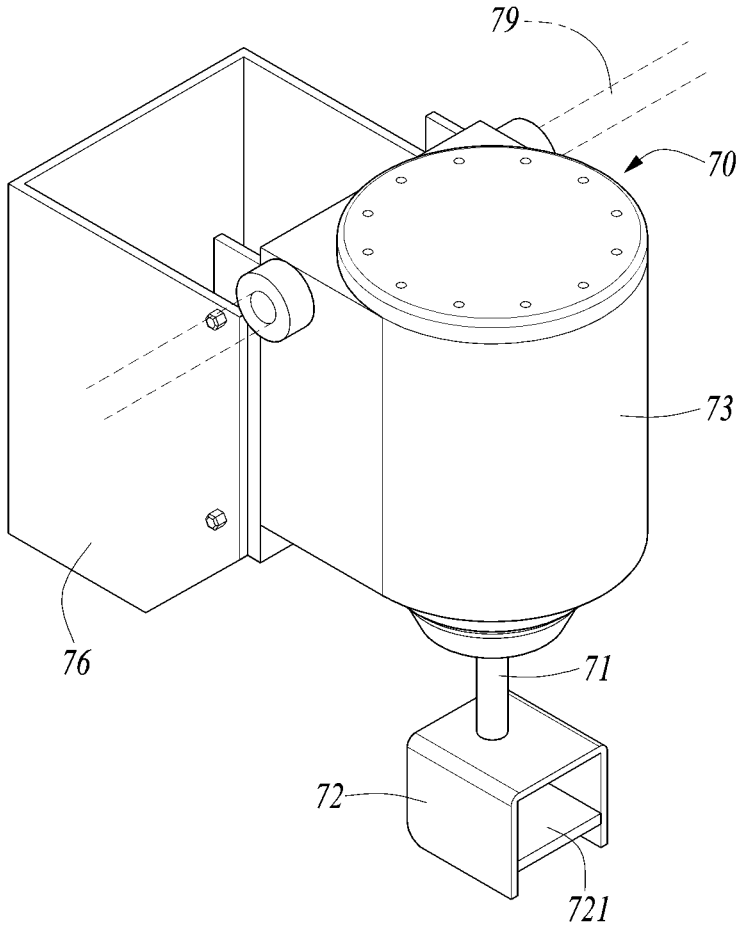
FIG. 14 is a perspective view illustrating one prestress locking member according to the first exemplary embodiment.
Figure 15:
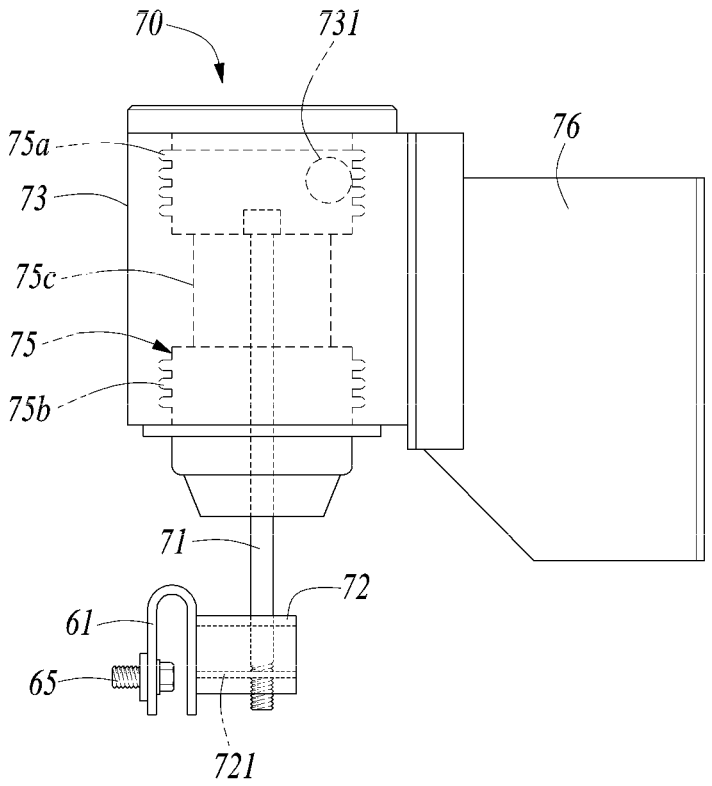
FIG. 15 is a side view illustrating the prestress locking member according to the first exemplary embodiment.

FIG. 14 is a perspective view illustrating a prestress locking member according to the first exemplary embodiment. FIG. 15 is a side view illustrating the prestress locking member according to the first exemplary embodiment.

Referring to FIGS. 14 and 15, each of the prestress locking members 70 is fixed to the inner wall of the housing 1200, and includes a casing 73, an insulator 75 installed in the casing 73, a pressure rod 71 coupled to the insulator 75, and a pressing support 72 coupled to the pressure rod 71.

The casing 73 is cylindrical and has an internal space, and a bracket 76 is installed to one side of the casing 73 to fix the casing 73 to the housing 1200. The casing 73 may be provided with an air inlet 731 and a purge air supply pipe 79 may be connected to the air inlet 731. The purge air introduced into the casing 73 prevents a short circuit due to moisture while the purge air is discharged downward.

The insulator 75 may include an upper insulator 75*a* fixed to the upper portion of the casing 73, a lower insulator 75*b* fixed to the lower portion of the casing 73, and an insulating tube 75*c* connecting the upper insulator 75*a* and the lower insulator 75*b*. The pressure rod 71 is fixed to the insulator 75 and protrudes downward of the prestress locking member 70. The pressure rod 71 has a thread formed on the lower portion thereof for fastening with the pressing support 72.

The pressing support 72 is fixed to the lower portion of the pressure rod 71 and includes an inner support plate 721 to fasten with the pressure rod 71. The inner support plate 721 is screwed to the pressure rod 71. The pressing support 72 abuts on the outer upper support beam 61 to press the outer upper support beam 61 into the collection module 100.

When the outer upper support beam 61 is installed in the state in which it is pressured by the prestress locking member 70 as in the first exemplary embodiment, it may be possible to effectively reduce the vibration of the collection module 100.

Figure 16:
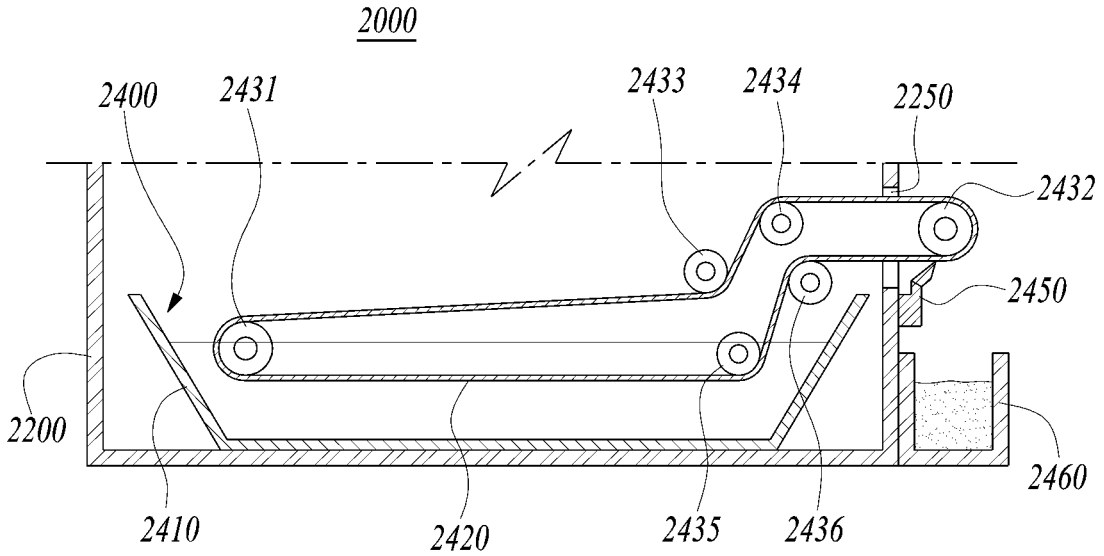
FIG. 16 is a cross-sectional view illustrating a washing water treatment device according to a second exemplary embodiment.

Hereinafter, an electrostatic precipitator apparatus according to a second exemplary embodiment will be described. FIG. 16 is a cross-sectional view illustrating a washing water treatment device according to the second exemplary embodiment.

Referring to FIG. 16, since the electrostatic precipitator apparatus, which is designated by reference numeral 2000, according to the second exemplary embodiment has the same structure as the electrostatic precipitator apparatus according to the first exemplary embodiment, except for a washing water treatment device 2400, a redundant description thereof will be omitted.

The electrostatic precipitator apparatus 2000 according to the second exemplary embodiment is a wet electrostatic precipitator apparatus and includes the washing water treatment device 2400 disposed inside a housing 2200. The housing 2200 has a substantially rectangular shape, and has an opening 2250 formed on one side of the lower portion thereof so that an adsorption belt 2420 protrudes through the opening 2250.

The washing water treatment device 2400 stores washing water having passed through a collection module and separates dust contained in the washing water. The washing water treatment device 2400 may include a reservoir 2410 configured to store washing water, the adsorption belt 2420 installed at the upper portion of the reservoir 2410, a plurality of rollers configured to move the adsorption belt 2420, and a scraper 2450 configured to separate the dust attached on the adsorption belt 2420. Here, the washing water may be water or an aqueous sodium hydroxide solution. When the aqueous sodium hydroxide solution is used as the washing water, the washing capability of the washing water treatment device can be improved.

The reservoir 2410 is disposed on the bottom of the housing 2200 and stores the washing water supplied through a washing water feeder 2300 therein. The adsorption belt 2420 may be in a mesh form. That is, the adsorption belt 2420 may be formed of a metal or synthetic resin mesh as a net structure that warps and wefts are entangled. In addition, a plurality of fine protrusions for adsorption of dust may be formed on a wire forming the adsorption belt 2420. Here, the fine protrusions refer to protrusions having a diameter smaller than 0.1 mm. On the other hand, the adsorption belt 2420 may be formed of a porous metal or resin plate. When the adsorption belt 2420 is in the mesh form, the dust contained in the washing water may be attached on the adsorption belt 2420 and the washing water may flow into the reservoir through the adsorption belt 2420.

The adsorption belt 2420 is in an endless-track form that its longitudinal ends are connected to each other. The lower portion of the adsorption belt 2420 is submerged in the washing water and the upper portion of the adsorption belt 2420 is positioned above the washing water for exposure out of the washing water.

The rollers are installed to the adsorption belt 2420 to support and move the adsorption belt 2420. The rollers include two support rollers 2431 and 2432 positioned at both longitudinal ends of the adsorption belt, and two first diversion rollers 2433 and 2435, which support the adsorption belt 2420 to be bent vertically, and two second diversion rollers 2434 and 2436 which are disposed adjacent to the first diversion rollers 2433 and 2435 and support the adsorption belt 2420 to be bent laterally. The support rollers 2431 and 2432 abut on the inward surface of the adsorption belt 2420, the first diversion rollers 2433 and 2435 abut on the upper surface of the adsorption belt 2420, and the second diversion rollers 2434 and 2436 abut on the lower surface of the adsorption belt 2420.

The support roller 2431 is positioned inside the reservoir and the other support roller 2432 is positioned outside the housing 2200. Thus, a portion of the adsorption belt 2420 may protrude outward from the housing 2200. The adsorption belt 2420 protrudes outward through the opening 2250 from the housing 2200. The scraper 2450 may be installed on the outer wall of the housing 2200 and may extend in the width direction of the adsorption belt 2420. The scraper 2450 abuts on the lower surface of the adsorption belt 2420 to scrape off the dust attached on the adsorption belt 2420 to separate the dust from the adsorption belt 2420. A dust separation container 2460 is installed beneath the scraper 2450 to accommodate the mass of dust separated from the adsorption belt 2420.

As described above, according to the second exemplary embodiment, it may be possible to more cleanly manage the washing water since the scraper 2450 is disposed on the outside of the housing 2200 to separate the dust attached on the adsorption belt 2420 from the reservoir 2410 for accommodation of the dust.

Figure 17:
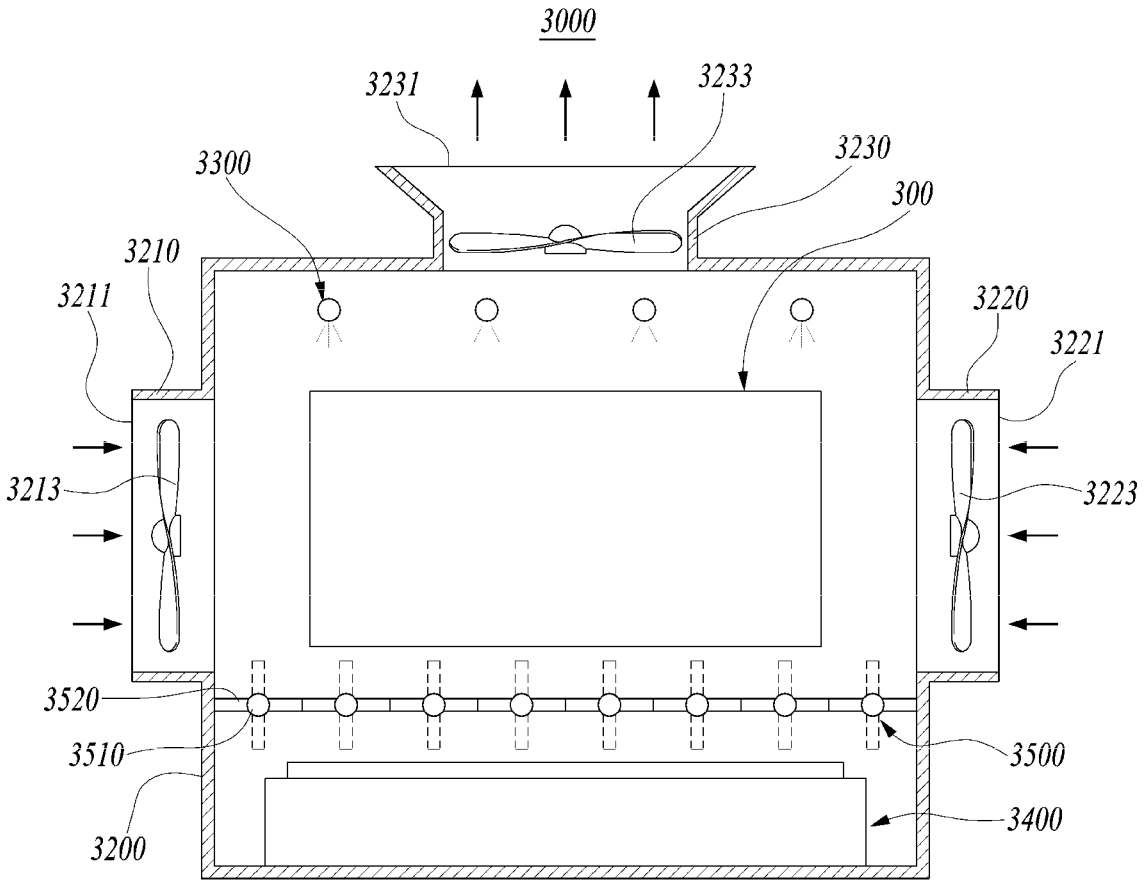
FIG. 17 is a cross-sectional view illustrating a washing water treatment device according to a third exemplary embodiment.

Hereinafter, an electrostatic precipitator apparatus according to a third exemplary embodiment will be described. FIG. 17 is a cross-sectional view illustrating a washing water treatment device according to the third exemplary embodiment.

Referring to FIG. 17, since the electrostatic precipitator apparatus according to the third exemplary embodiment has the same structure as the electrostatic precipitator apparatus according to the first exemplary embodiment, except for a housing and a blocking member, a redundant description thereof will be omitted.

The electrostatic precipitator apparatus, which is designated by reference numeral 3000, according to the third exemplary embodiment may include a housing 3200, a collection module 300, a frame assembly, a washing water feeder 3300, and a washing water treatment device 3400. The housing 3200 may be of a substantially rectangular parallelepiped shape, and have inlet ducts 3210 and 3220 formed on the respective opposite sides thereof and an outlet duct 3230 formed on the upper surface thereof.

The inlet ducts 3210 and 3220 are respectively provided with inlets 3211 and 3221 for introduction of gas, and the outlet duct 3230 is provided with an outlet 3231 for discharge of gas. In addition, blowers 3213 and 3223 are installed in the inlet ducts 3210 and 3220 to forcibly introduce gas thereinto, and a blower 3233 is installed in the outlet duct 3230 to forcibly discharge gas therefrom. Thus, gas may be introduced from both sides of the housing 3200 and the purified gas may be discharged upward.

Meanwhile, a blocking member 3500 is installed between the collection module 300 and the washing water treatment device 3400. The blocking member 3500 may be rotatably installed in the housing, and include a plurality of blocking plates 3520 and rotary columns 3510 connected to the widthwise centers of the respective blocking plates 3520. An actuator may be installed to the rotary columns 3510 to rotate the rotary columns 3510 so that the blocking member 3500 may rotate about the rotary columns 3510.

When the blocking plates 3510 are disposed horizontally to the ground, the side ends of the blocking plates 3520 are in contact with each other so that the space where the collection module 300 is placed is separated from the space where the washing water treatment device 3400 is placed. On the other hand, the blocking plates 3520 may be erected perpendicularly to the ground during washing, thereby enabling washing water to easily move from the collection module 300 to the washing water treatment device 3400.

As described above, according to the third exemplary embodiment, by virtue of the inflow of gas from both sidewalls of the housing 3200, it may be possible to quickly purify a larger amount of gas. In addition, by virtue of the installation of the blocking member 3500, it may be possible to easily discharge gas to the outlet duct 3230.

Figure 18:
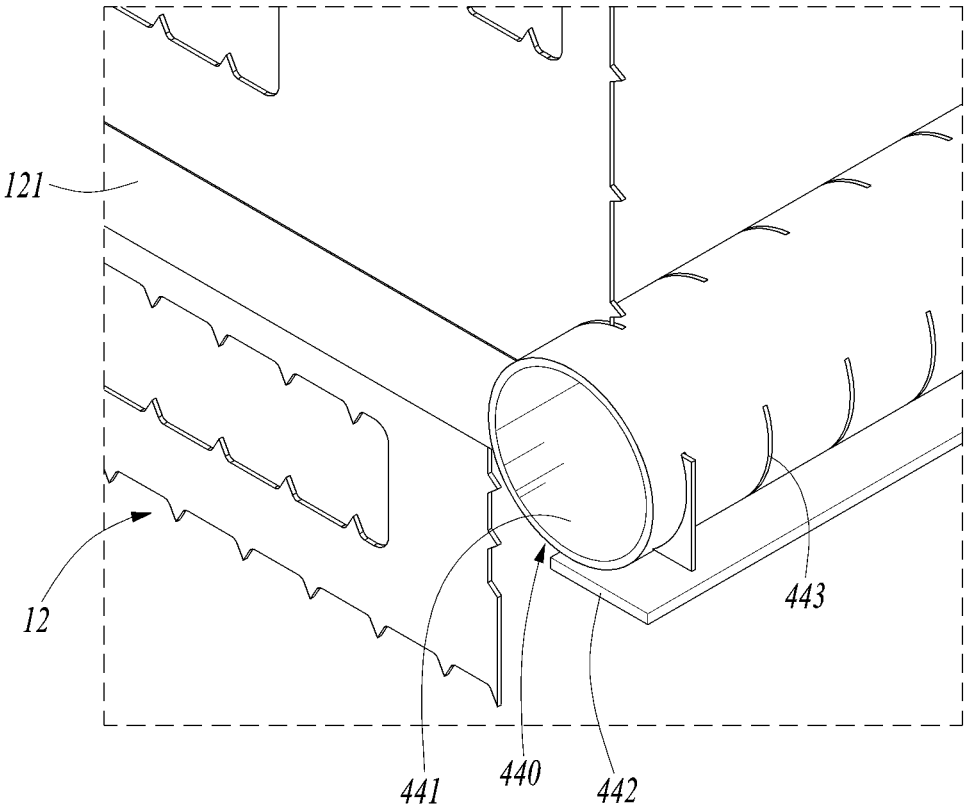
FIG. 18 is a perspective view partially illustrating one first setting beam and one discharge electrode according to a fourth exemplary embodiment.

Hereinafter, a collection module according to a fourth exemplary embodiment will be described. FIG. 18 is a perspective view partially illustrating a first setting beam and a discharge electrode according to the fourth exemplary embodiment.

Referring to FIG. 18, since the collection module according to the fourth exemplary embodiment has the same structure as that of the collection module according to the first exemplary embodiment, except for the first setting beam, a redundant description thereof will be omitted.

The first setting beam, which is designated by reference numeral 440, extends in the stacking direction of the discharge electrodes 12, and has a plurality of lower slots 443 into which the side ends of the respective discharge electrodes 12 are inserted. The first reinforcement rod 121 of each discharge electrode 12 is inserted into the first setting beam 440. The first reinforcement rod 121 is installed to pass through the first setting beam 440, and the lower end of the first reinforcement rod 121 is supported by the first setting beam 440.

The first setting beam 440 includes a tubular support pipe 441 having a circular cross-section and a lower support plate 442 fixed to the lower end of the support pipe 441. The support pipe 441 has the plurality of lower slots 443 into which the first reinforcement rods 121 and side ends of the respective discharge electrodes 12 are inserted.

Meanwhile, the lower support plate 442 if of a flat plate shape and is fixedly installed to the lower end of the support pipe 441. The lower support plate 442 abuts on the lower surfaces of the first reinforcement rods 121 to support the first reinforcement rods 121.

As described above, according to the fourth exemplary embodiment, it may be possible to more easily couple the first setting beam 440 to the discharge electrodes 12.

Figure 19:
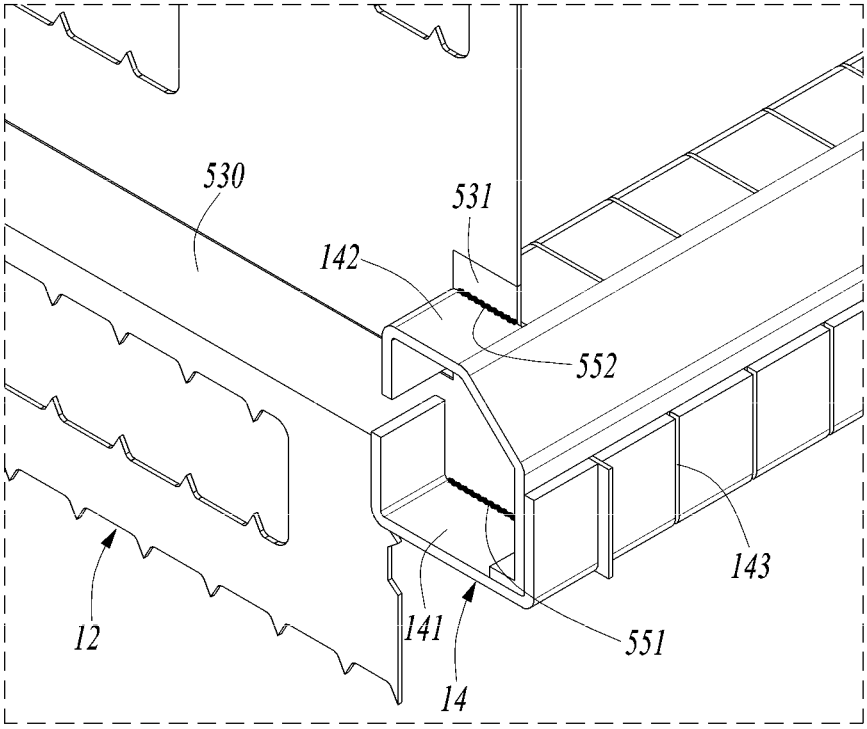
FIG. 19 is a perspective view partially illustrating one first setting beam and one discharge electrode according to a fifth exemplary embodiment.

Hereinafter, a collection module according to a fifth exemplary embodiment will be described. FIG. 19 is a perspective view partially illustrating a first setting beam and a discharge electrode according to the fifth exemplary embodiment.

Referring to FIG. 19, since the collection module according to the fifth exemplary embodiment has the same structure as the collection module according to the first exemplary embodiment, except for a structure of a first reinforcement rod 530, a redundant description thereof will be omitted.

The discharge electrode 12 includes the first reinforcement rod 530 installed at the lower portion thereof, and the first reinforcement rod 530 is coupled to the first setting beams 14 to support the discharge electrode 12. The first reinforcement rod 530 is longer than the width of the discharge electrode 12 so as to protrude from both side ends of the discharge electrode 12. The first reinforcement rod 530 may be bonded to the first setting beam 14 through a first welding portion 551.

The first reinforcement rod 530 has a support protrusion 531 protruding upward. The support protrusion 531 may pass through the upper end of the first setting beam 14 and may be bonded to the first setting beam 14 by welding. Thus, the support protrusion 531 is bonded to the first setting beam 14 through a second welding portion 552.

The first setting beam 14 extends in the stacking direction of the discharge electrodes 12, and has a plurality of lower slots 143 into which the side ends of the respective discharge electrodes 12 are inserted. The first reinforcement rod 530 is inserted into the first setting beam 14. The first reinforcement rod 530 is installed to pass through the first setting beam 14, and the lower end of the first reinforcement rod 530 is supported by the first setting beam 14.

The first setting beam 14 may include a lower beam 141 and an upper beam 142 coupled to the lower beam 141. The first welding portion 551 fixes a portion of the first reinforcement rod 530, which extends in the longitudinal direction of the discharge electrode, to the lower beam 141, and the second welding portion 552 fixes the support protrusion 531 to the upper beam 142.

As described above, according to the fifth exemplary embodiment, since the support protrusion 531 is formed on the first reinforcement rod 530 and the first reinforcement rod 530 is fixed by the first setting beam 14 and the first and second welding portions 551 and 552, the discharge electrode 12 can be fixed more stably.

Figure 20:
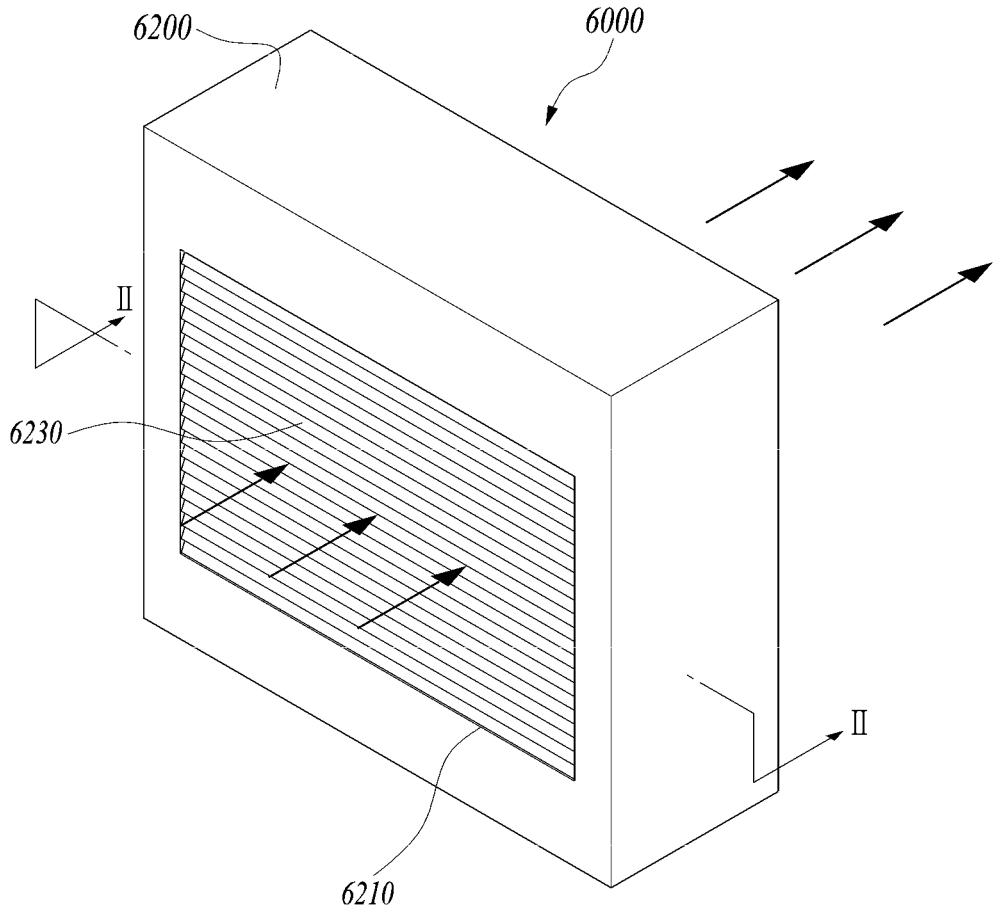
FIG. 20 is a perspective view illustrating an electrostatic precipitator apparatus according to a sixth exemplary embodiment.
Figure 21:
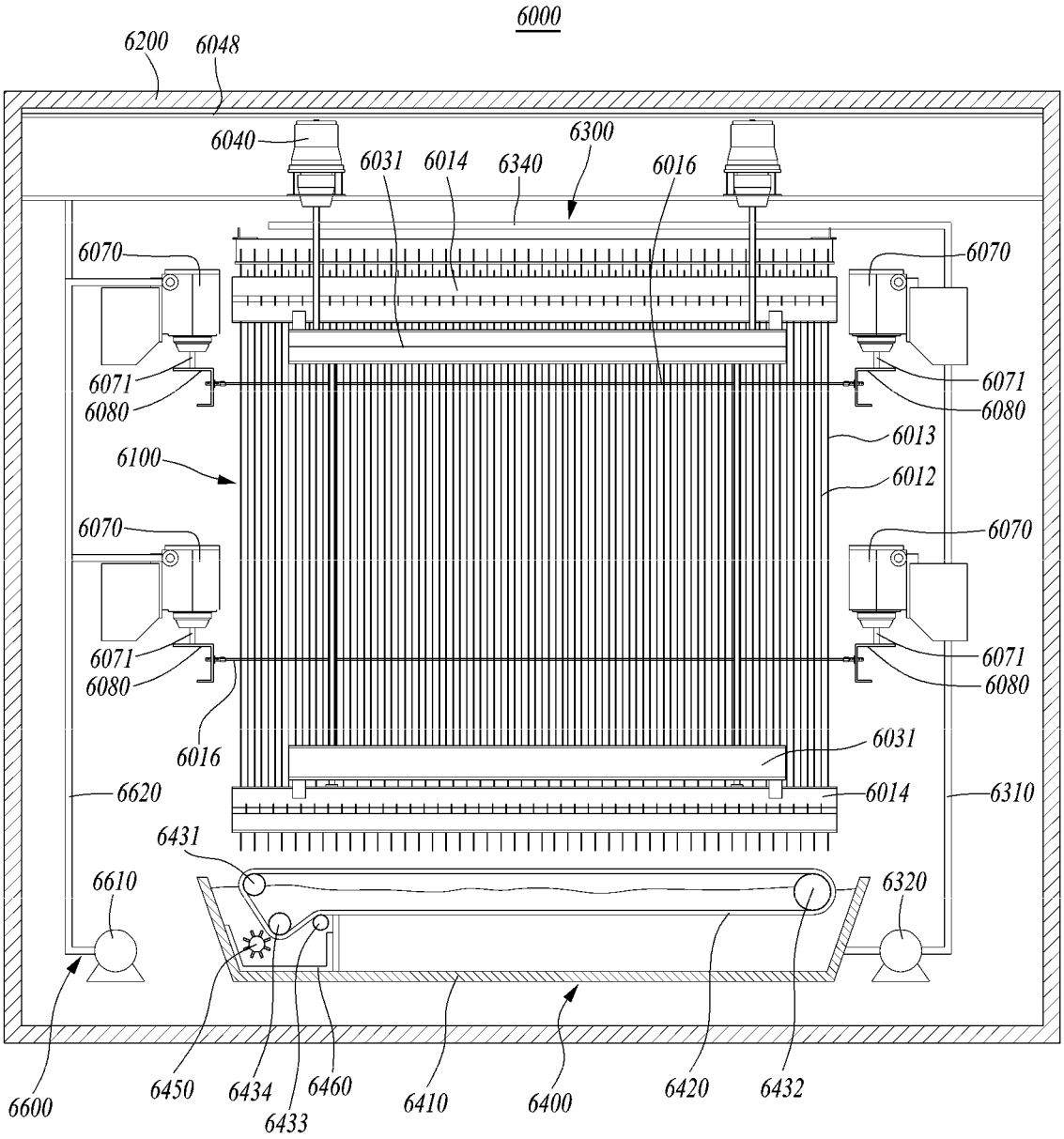
FIG. 21 is a longitudinal sectional view taken along line II-II of FIG. 20.
Figure 22:
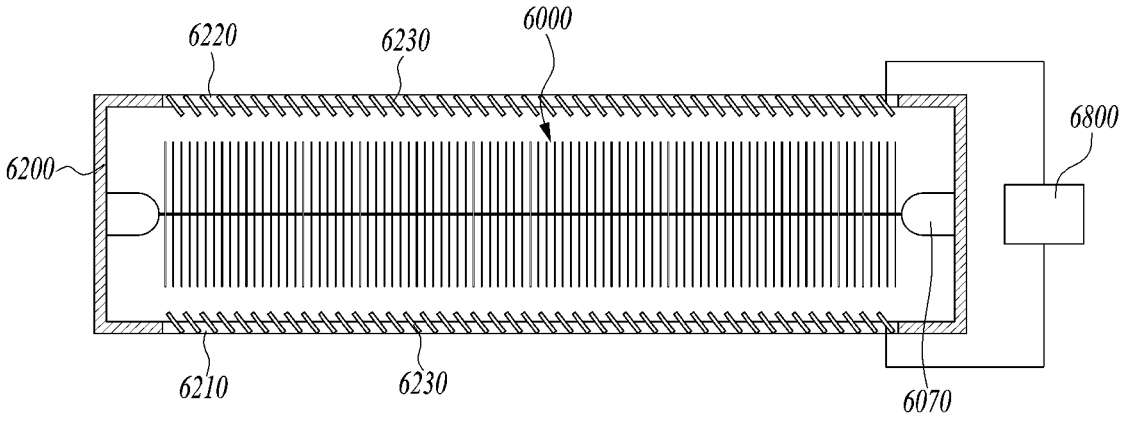
FIG. 22 is a cross-sectional view illustrating the electrostatic precipitator apparatus according to the sixth exemplary embodiment.
Figure 23:
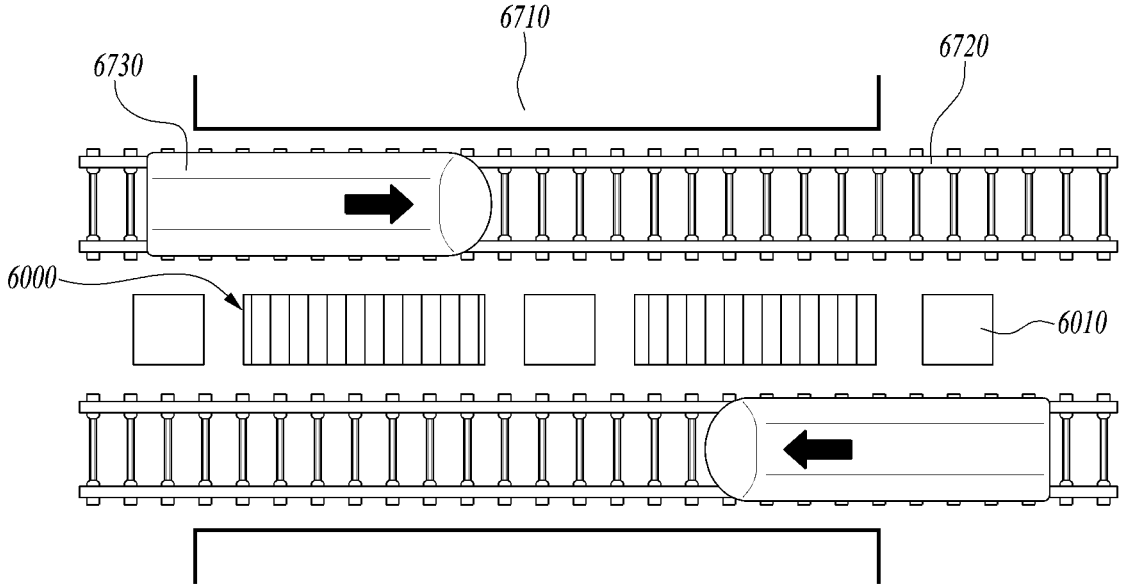
FIG. 23 is a view illustrating the electrostatic precipitator apparatus installed between rails according to the sixth exemplary embodiment.

Hereinafter, an electrostatic precipitator apparatus according to a sixth exemplary embodiment will be described. FIG. 20 is a perspective view illustrating the electrostatic precipitator apparatus according to the sixth exemplary embodiment. FIG. 21 is a longitudinal sectional view taken along line II-II of FIG. 20. FIG. 22 is a cross-sectional view illustrating the electrostatic precipitator apparatus according to the sixth exemplary embodiment. FIG. 23 is a view illustrating the electrostatic precipitator apparatus installed between rails according to the sixth exemplary embodiment.

Referring to FIGS. 20 to 23, the electrostatic precipitator apparatus, which is designated by reference numeral 6000, according to the sixth exemplary embodiment is an apparatus installed inside a station such as a subway station to remove dust from air or combustion gas. The electrostatic precipitator apparatus 6000 may be installed between subway platforms 6710, in particular, between two neighboring rails 6720. When the electrostatic precipitator apparatus 6000 is installed between the rails 6720, air may be introduced into and discharged from the electrostatic precipitator apparatus 6000 by means of wind generated when a train 6730 moves. One subway station may be provided with a plurality of the electrostatic precipitator apparatus 6000 which may be spaced apart from each other with columns 6010 interposed therebetween.

Each of the electrostatic precipitator apparatus 6000 may include a housing 6200, a collection module 6100, a washing water feeder 6300, a washing water treatment device 6400, a purge air feeder 6600, a controller 6800, and guide vanes 6230.

The housing 6200 may be formed of a rectangular box having an internal space. However, the present disclosure is not limited thereto, and the housing may have various shapes such as an elliptic cylinder or a cylinder. The housing 6200 may have first and second openings 6210 and 6220 formed on the respective opposite sides thereof, and the first and second openings 6210 and 6220 may be formed on the surfaces of the housing 6200 facing the rails 6720. Meanwhile, an advertisement board may be installed on the upper side or side of the housing 6200.

The guide vanes 6230 are installed in each of the first and second openings 6210 and 6220 to guide the inflow and outflow of air, and each guide vane 6230 is formed of a plate extending in the width direction of the housing 6200. The guide vanes 6230 are vertically spaced apart from each other in each of the first and second openings 6210 and 6220. The guide vanes 6230 may be rotatably installed in the housing 6200, and a motor or an actuator may be connected to the guide vanes 6230 to rotate the guide vanes 6230. However, the present disclosure is not limited thereto, and the guide vanes 6230 may be fixed so as not to rotate.

The controller 6800 may be connected to the guide vanes 6230 to control the rotation of the guide vanes 6230, and may cause the guide vanes 6230 to rotate as the train 6730 enters. For example, when the train 6730 approaches toward the first opening 6210, the controller 6800 may, based on the direction of movement of the train 6730, control the outer ends of the guide vanes 6230, installed in the first opening 6210, to face rearward while controlling the outer ends of the guide vanes 6230, installed in the second opening 6220, to face forward. In this case, the guide vanes 6230 installed in the first opening 6210 and the guide vanes 6230 installed in the second opening 6220 may be in parallel to each other. Accordingly, air may be guided by the guide vanes 6230 with the pressure generated when the train 6730 approaches, so that the air may be introduced into the first opening 6210 and then discharged through the second opening 6220.

On the other hand, when the train 6730 moves away from the first opening 6210, the controller 6800 may, based on the direction of movement of the train 6730, control the outer ends of the guide vanes 6230, installed in the first opening 6210, to face forward while controlling the outer ends of the guide vanes 6230, installed in the second opening 6220, to face rearward. In this case, the guide vanes 6230 installed in the first opening 6210 and the guide vanes 6230 installed in the second opening 6220 may be in parallel to each other. Accordingly, air may be guided by the guide vanes 6230 with the sound pressure generated when the train 6730 moves away from the first opening 6210, so that the air may be introduced into the second opening 6220 and then discharged through the first opening 6210.

Meanwhile, when the train 6730 approaches toward the second opening 6220, the controller 6800 may control the outer ends of the guide vanes 6230, installed in the second opening 6220, to face rearward based on the direction of movement of the train 6730. On the other hand, when the train 6730 moves away from the second opening 6220, the controller 6800 may control the outer ends of the guide vanes 6230, installed in the second opening 6220, to face forward based on the direction of movement of the train 6730. In this case, the guide vanes 6230 installed in the first opening 6210 and the guide vanes 6230 installed in the second opening 6220 may be controlled to be in parallel to each other.

As described above, the electrostatic precipitator apparatus 6000 according to the sixth exemplary embodiment enables the easy inflow and outflow of air with no separate blower by means of the pressure that changes according to the movement of the train, thereby reducing driving power.

The washing water feeder 6300 includes a washing water supply line 6310, a washing water pump 6320, and a spray line 6340. The washing water supply line 6310 is a pipe, which is inserted into a reservoir 6410 disposed on the bottom of the housing 6200 and extends from the reservoir 6410 to the top of the housing 6200. The washing water pump 6320 is connected to the washing water supply line 6310 to move washing water. The spray line 6340 is installed above the collection module 6100 to spray washing water toward the collection module 6100. The spray line 6340 may be provided with a nozzle and may extend in the stacking direction of discharge and collection electrodes 6012 and 6013. The washing water feeder 6300 may operate intermittently, for example, for a few minutes every few hours. When washing water is supplied, no voltage is applied to the discharge electrodes 6012.

The purge air feeder 6600 may include an air pump 6610 and an air supply pipe 6620. The air supply pipe 6620 may be connected to a tubular girder 6048 and prestress locking members 6070 to supply purge air to the tubular girder 6048 and the prestress locking members 6070.

The washing water feeder 6300 sprays washing water to the collection module 6100 to remove the dust attached on the collection electrodes 6013. The washing water feeder 6300 operates when no voltage is applied to the collection module 6100.

Figure 24:
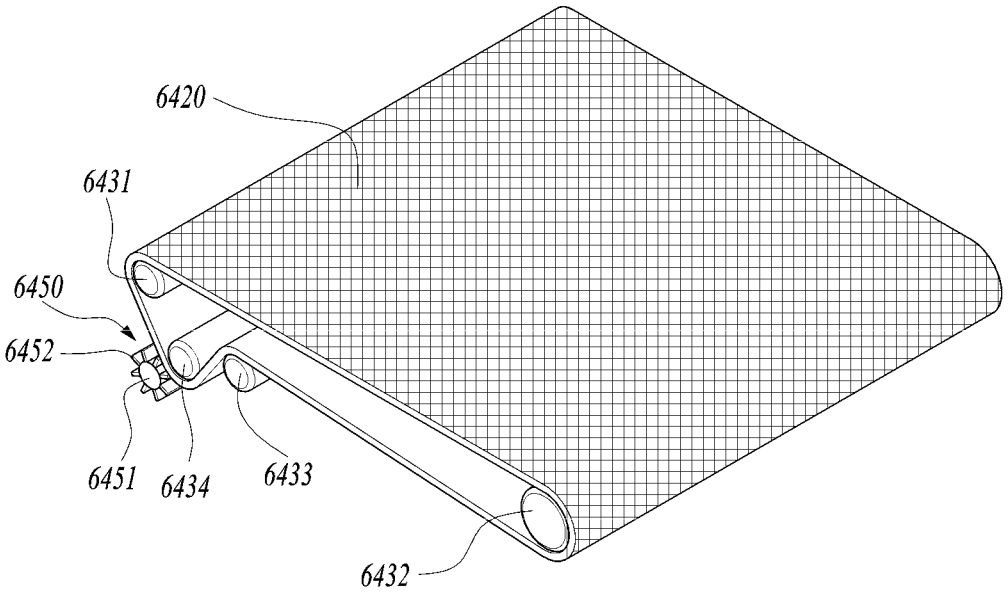
FIG. 24 is a perspective view illustrating a portion of a washing water treatment device according to the sixth exemplary embodiment.

FIG. 24 is a perspective view illustrating a portion of the washing water treatment device according to the sixth exemplary embodiment.

Referring to FIGS. 21 and 24, the washing water treatment device 6400 is disposed in the lower portion of the housing. The washing water treatment device 6400 accommodates washing water dropped from the collection module 6100 and solidifies dust contained in the washing water. The washing water treatment device 6400 may include a reservoir 6410 configured to store washing water, an adsorption belt 6420 installed at the upper portion of the reservoir 6410, rollers configured to move the adsorption belt 6420, and a scraper 6450 configured to separate the dust attached on the adsorption belt 6420. Here, the washing water may be water or an aqueous sodium hydroxide solution. When the aqueous sodium hydroxide solution is used as the washing water, the washing capability of the washing water treatment device can be improved.

The reservoir 6410 is disposed on the bottom of the housing 6200 and stores the washing water supplied through the washing water feeder 6300 therein. The reservoir 6410 may be connected to a washing water replenishment line for replenishment of washing water, and the washing water replenishment line may have a valve installed therein.

The adsorption belt 6420 may be in a mesh form, and be made of porous metal or synthetic resin. When the adsorption belt 6420 is in the mesh form, the dust contained in the washing water may be attached on the adsorption belt 6420 and the washing water may flow into the reservoir 6410 through the adsorption belt 6420.

That is, the adsorption belt 6420 may be formed of a metal or synthetic resin mesh as a net structure that warps and wefts are entangled. In addition, a plurality of fine protrusions for adsorption of dust may be formed on a wire forming the adsorption belt 6420. Here, the fine protrusions refer to protrusions having a diameter smaller than 0.1 mm. On the other hand, the adsorption belt 6420 may be formed of a porous metal or synthetic resin plate. When the adsorption belt 6420 is in the mesh form, the dust contained in the washing water may be attached on the adsorption belt 6420 and the washing water may flow into the reservoir 6410 through the adsorption belt 6420.

The adsorption belt 6420 is in an endless-track form that its longitudinal ends are connected to each other. The lower portion of the adsorption belt 6420 is submerged in the washing water and the upper portion of the adsorption belt 6420 is positioned above the washing water for exposure out of the washing water. During the operation of the adsorption belt 6420, the lower portion of the adsorption belt 6420 adsorbs the dust in the washing water and the upper portion thereof adsorbs the dust contained in the dropping washing water. The dust may be adsorbed onto the exposed portion of the adsorption belt 6420 and move to the scraper 6450.

The rollers are installed to the adsorption belt 6420 to support and move the adsorption belt 6420. The rollers include two support rollers 6431 and 6432 positioned at both longitudinal ends of the adsorption belt, and first and second diversion rollers 6433 and 6434 disposed between the support rollers 6431 and 6432 to support the lower portion of the adsorption belt 6420 to be bent vertically. The support rollers 6431 and 6432 abut on the inward surface of the adsorption belt 6420, the first diversion roller 6433 abuts on the outer surface of the adsorption belt 6420, and the second diversion roller 6434 abuts on the outward surface of the adsorption belt 6420.

The first diversion roller 6433 supports the lower end of the adsorption belt 6420 to move upward so that the lower end of the adsorption belt 6420 is inclined relative to the ground. The vertical distance between the upper and lower portions of the adsorption belts 6420 decreases from one support roller 6432 to the first diversion roller 6433. The second diversion roller 6434 is disposed between the first diversion roller 6433 and the support roller 6431 to support the lower end of the adsorption belt 6420 to be inclined upward.

The second diversion roller 6434 allows the lower end of the adsorption belt 6420 to be positioned beneath the upper end of a blocking wall 6415. That is, the first diversion roller 6433 supports the adsorption belt 6420 to move above the upper end of the blocking wall 6415, thereby preventing the adsorption belt 6420 from interfering with the blocking wall 6415. The second diversion roller 6434 allows the lower end of the adsorption belt 6420 to be positioned beneath the blocking wall 6415, thereby preventing a mass of dust from crossing the blocking wall 6415. The scraper 6450 abuts on the adsorption belt 6420 between the second diversion roller 6434 and the support roller 6431.

The blocking wall 6415 is installed in the reservoir 6410 and separates the space, in which the scraper 6450 is present, from a remaining space. The blocking wall 6415 may be positioned between the first diversion roller 6433 and the second diversion roller 6434, but the present disclosure is not limited thereto. For example, the blocking wall 6415 may be disposed adjacent to the scraper 6450. The first diversion roller 6433 may be positioned above the blocking wall 6415.

The scraper 6450 is installed in the reservoir and abuts on the lower portion of the adsorption belt 6420 to scrape off the dust attached on the adsorption belt 6420 to separate the dust from the adsorption belt 6420. The scraper 6450 includes a rotary rod 6451 and a plurality of paddles 6452 protruding from the outer peripheral surface of the rotary rod 6451. The paddles 6452 may be plates extending in the longitudinal direction of the rotary rod 6451 and be spaced apart from each other in the circumferential direction of the rotary rod 6451. The paddles 6452 may each be made of an elastic material and abut on the adsorption belt 6420 to scrape off dust. A motor may be connected to the rotary rod 6451 to rotate the rotary rod 6451.

The mass of dust separated by the scraper 6450 is solidified and accumulated on the bottom of the reservoir 6410 so that relatively clean washing water is present at the upper portion of the reservoir 6410. Since the mass of dust is placed in the space separated by the blocking wall 6415, the washing water in the remaining space can be purified.

Meanwhile, the separation container 6460 may be installed beneath the scraper 6450 to accommodate a mass of dust. The separation container 6460 may be positioned in the space separated by the blocking wall 6415, and be of a triangular longitudinal section. Thus, the mass of dust in the separation container 6460 cannot be easily separated from the separation container, and a worker can easily manage the washing water by periodically replacing the separation container.

According to the sixth exemplary embodiment, the washing water stored in the reservoir 6410 can be used for a predetermined period without being discharged. In addition, when the washing water needs to be replaced, the worker can remove the mass of dust from the bottom of the reservoir 6410 and replace the washing water.

Figure 25:
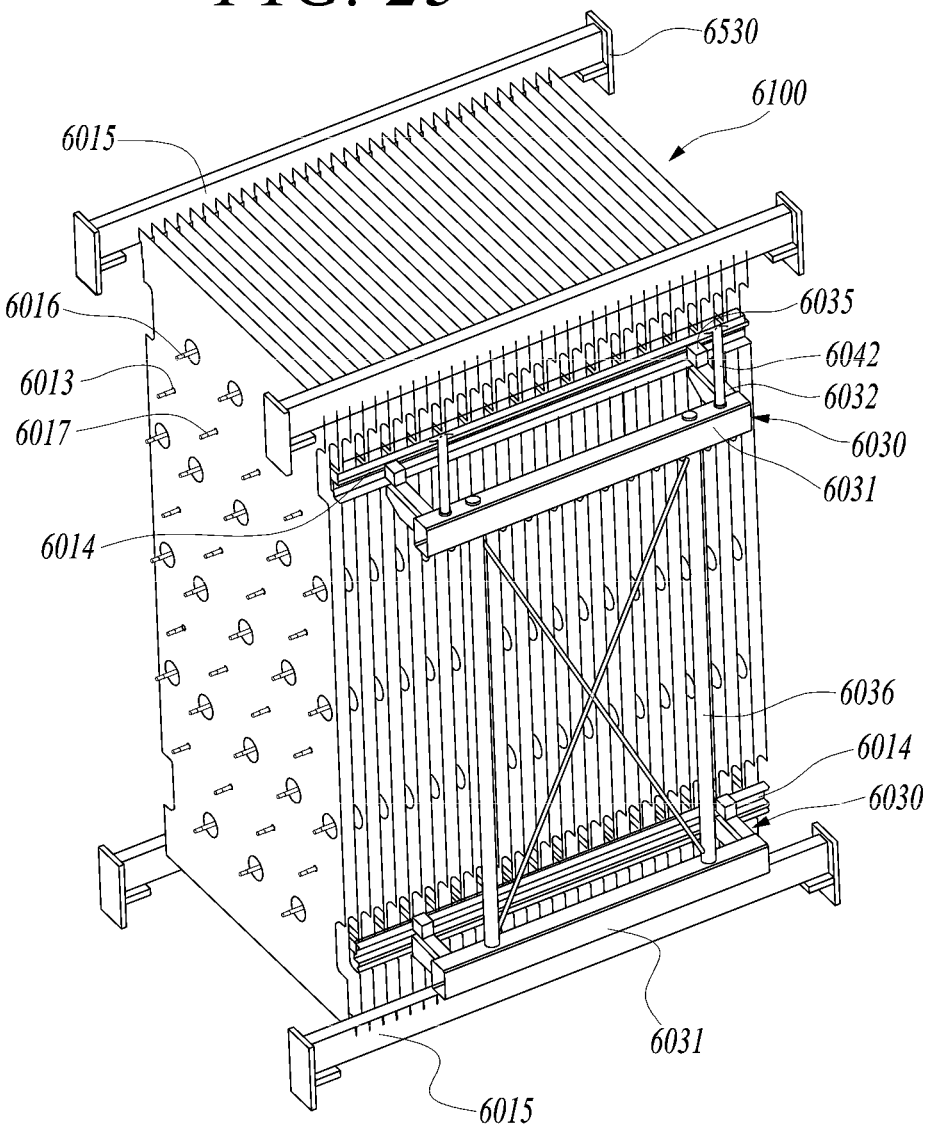
FIG. 25 is a perspective view illustrating a collection module according to the sixth exemplary embodiment.
Figure 26:
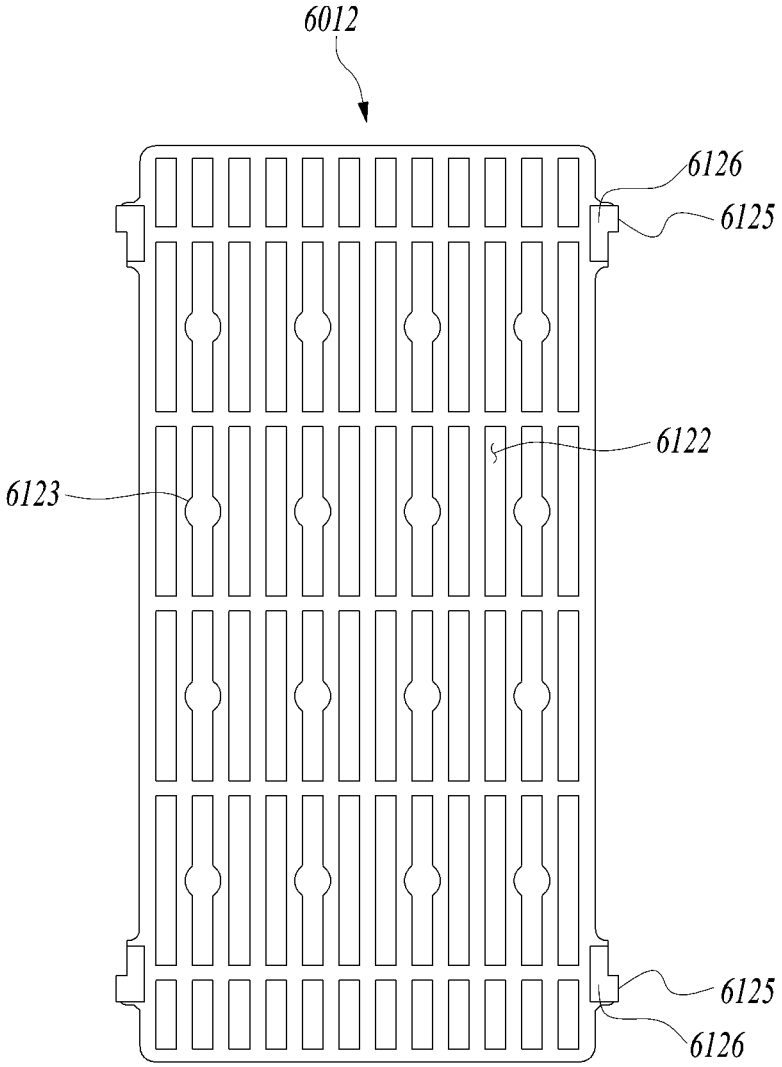
FIG. 26 is a front view illustrating one discharge electrode according to the sixth exemplary embodiment.
Figure 27:
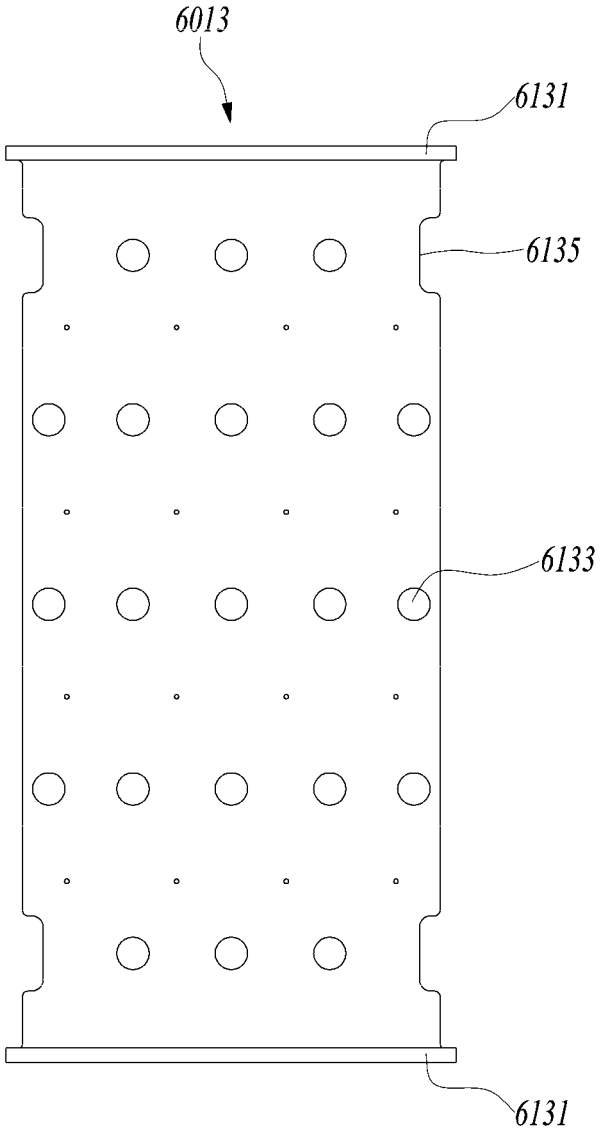
FIG. 27 is a front view illustrating one collection electrode according to the sixth exemplary embodiment.

FIG. 25 is a perspective view illustrating the collection module according to the sixth exemplary embodiment. FIG. 26 is a front view illustrating one discharge electrode according to the sixth exemplary embodiment. FIG. 27 is a front view illustrating one collection electrode according to the sixth exemplary embodiment.

Referring to FIGS. 21 and 25 to 27, the collection module 6100 includes the discharge electrodes 6012, collection electrodes 6013, first tie rods 6016, second tie rods 6017, first setting beams 6014, second setting beams 6015, and insulating connection members 6040, the prestress locking members 6070, lower frames 6030, and the tubular girder 6048.

Each of the discharge electrodes 6012 is of a flat plate shape and has a plurality of openings 6122. The discharge electrode 6012 may be formed of a rectangular plate whose height is larger than its width. The openings 6122 may each be of a square shape, and the discharge electrode 6012 has a plurality of discharge pins formed at the edges thereof. The discharge pins may each be in a needle form and may be spaced apart from each other along the outer end and the openings 6122 of the discharge electrode 6012.

The discharge electrode 6012 includes a plurality of reinforcement protrusions 6125 protruding from the side ends thereof, and the reinforcement protrusions 6125 are formed on both side ends of upper and lower portions of the discharge electrode, respectively. Reinforcement plates 6126 may be attached to the respective reinforcement protrusions 6125 and may each be formed of a substantially L-shaped plate. The reinforcement plates 6126 are coupled to the first setting beams 6014 to support the discharge electrode 6012. The discharge electrode 6012 may have a plurality of first holes 6123 through which the second tie rods 6017 pass.

Each of the collection electrodes 6013 is formed of a flat plate and has a plurality of second holes 6133 through which the first tie rods 6016 pass. The collection electrode 6013 may be formed of a rectangular plate whose height is larger than its width.

The collection electrode 6013 includes reinforcement rods 6131 disposed at the upper and lower ends thereof to support the collection electrode 6013. The reinforcement rods 6131 may be longer than the width of the collection electrode 6013 to protrude from both side ends of the collection electrode 6013.

The plurality of discharge electrodes 6012 and collection electrodes 6013 are arranged in parallel to each other, and the discharge electrodes 6012 are equally disposed between the respective collection electrodes 6013. The collection electrode 6013 has avoidance grooves 6135 formed on both side ends of upper and lower portions thereof, and the first setting beams 6014 are installed to pass through portions where the avoidance grooves 6135 are formed. The upper end of each of the avoidance grooves 6135 may be formed above the associated reinforcement plate of the discharge electrode to prevent the short circuit of the collection electrode 6013 to the discharge electrode 6012.

When a high voltage is applied to the discharge electrode 6012, a corona discharge occurs between the discharge electrode 6012 and the collection electrode 6013 to generate an electrostatic force. Particulates are charged by combining them with ions (e.g., electrons) generated during the corona discharge while air and droplets move to the region where the electrostatic force is generated with the corona discharge, and then the charged particulates are attached on the collection electrode 6013 by the electrostatic force. Thus, the dust and fine droplets are attached on the collection electrode 6013 and removed from the exhaust air.

Each of the first tie rods 6016 is fitted to the plurality of discharge electrodes 6012 through the associated second holes 6133 formed in the collection electrodes 6013, in which case the first tie rod 6016 does not come into contact with the collection electrodes 6013.

Figure 28:
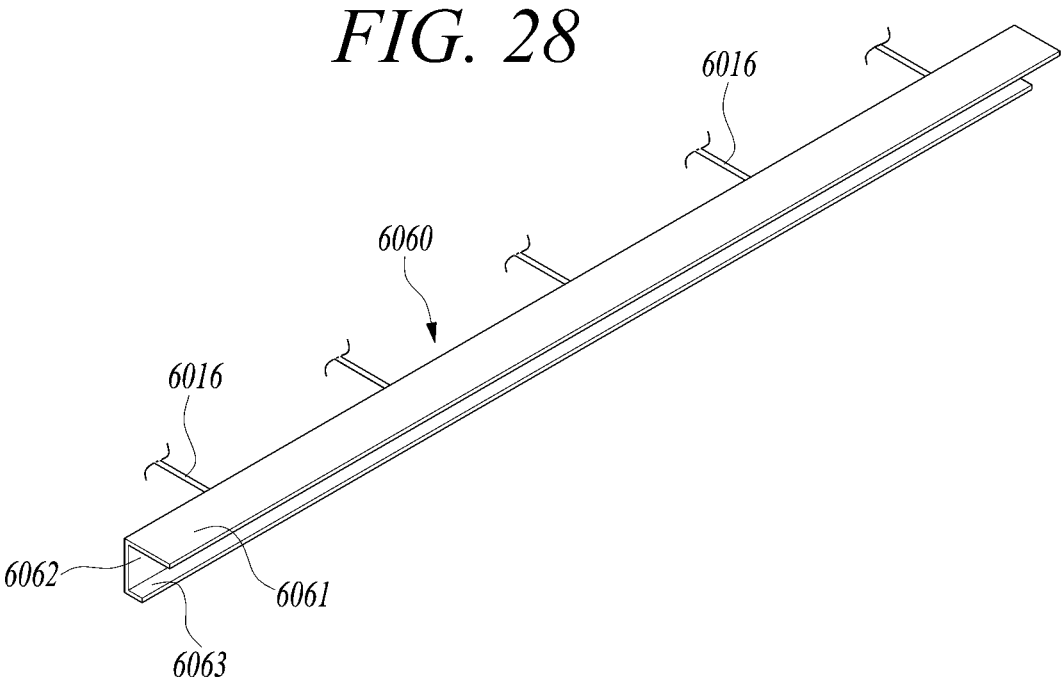
FIG. 28 is a perspective view illustrating one discharge electrode support beam according to the sixth exemplary embodiment.

The first tie rod 6016 may have threads formed on the longitudinal ends thereof, and the ends of the first tie rod 6016 may be fixed to discharge electrode support beams 6060. As illustrated in FIG. 28, the discharge electrode support beams 6060 are disposed at the respective outermost sides of the stacked discharge electrodes 6012 and extend in the width direction of the discharge electrodes 6012. Each of the discharge electrode support beams 6060 includes an upper support plate 6061, a side support plate 6062 bent downward from the upper support plate 6061, and a lower support plate 6063 bent from the side support plate 6062 to be parallel to the upper support plate 6061. The first tie rod 6016 is coupled to the side support plate 6062, and the lower support plate 6063 has a smaller width than the upper support plate 6061. The discharge electrode support beams 6060 may be fixed to the inner walls of the housing 6200 through insulating devices.

Meanwhile, each of the second tie rods 6017 is fitted to the plurality of collection electrodes 6013 through the associated first holes 6123 formed in the discharge electrodes 6012, in which case the second tie rod 6017 does not come into contact with the discharge electrodes 6012. The second tie rod 6017 may have longitudinal ends fixed to collection electrode support beams 6080.

The first and second tie rods 6016 and 6017 may have spacers installed to maintain the distance between the discharge electrode 6012 and the collection electrode 6013. That is, the spacer installed on the first tie rod 6016 may pass through an associated second hole 6133 of each collection electrode 6013 so that both longitudinal ends of the spacer abut on the facing surfaces of the discharge electrodes 6012 adjacent to the collection electrode 6013. In addition, the spacer installed on the second tie rod 6017 may pass through an associated first hole 6123 of each discharge electrode 6012 so that both longitudinal ends of the spacer abut on the facing surfaces of the collection electrodes 6013 adjacent to the discharge electrode 6012. The first and second tie rods 6016 and 6017 are each made of a nonconductor.

Figure 29:
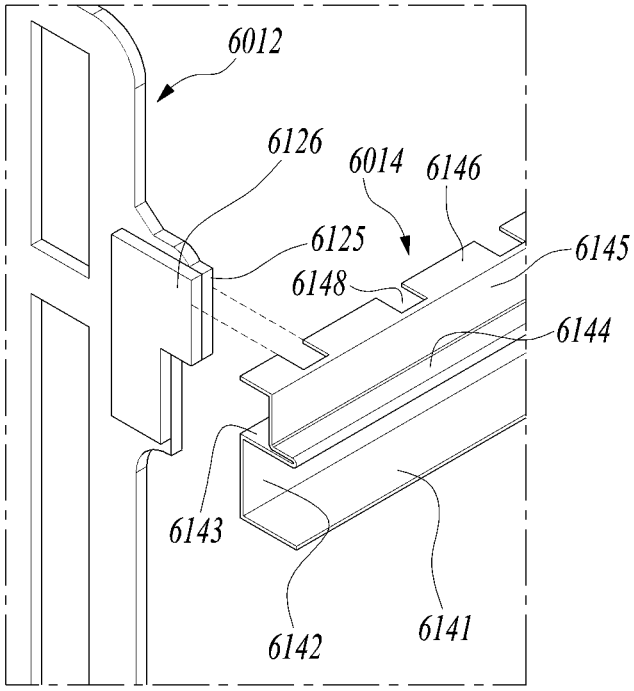
FIG. 29 is an exploded perspective view partially illustrating one first setting beam and one discharge electrode according to the sixth exemplary embodiment.
Figure 30:
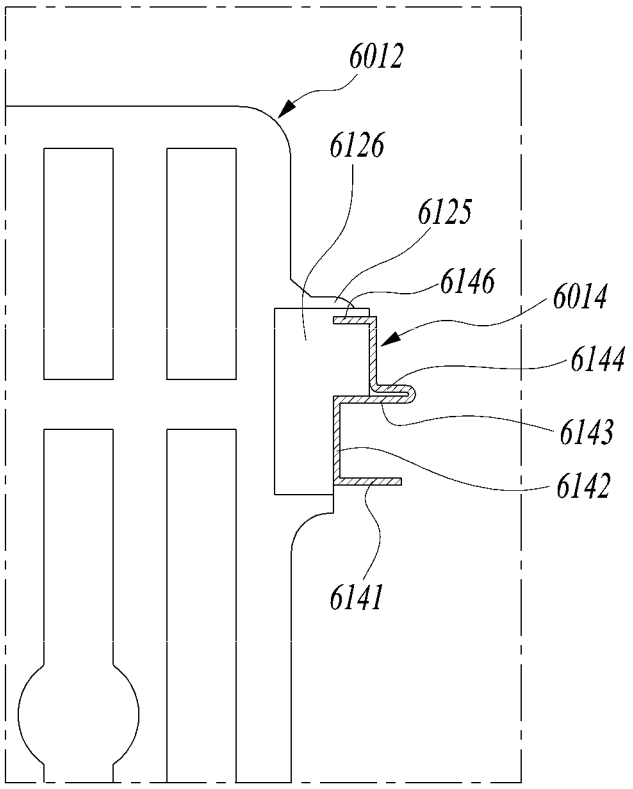
FIG. 30 is a cutaway cross-sectional view illustrating a state in which the first setting beam and the discharge electrode are coupled to each other.

FIG. 29 is an exploded perspective view partially illustrating one first setting beam and one discharge electrode according to the sixth exemplary embodiment. FIG. 30 is a cutaway cross-sectional view illustrating a state in which the first setting beam and the discharge electrode are coupled to each other.

Referring to FIGS. 29 and 30, each of the first setting beams 6014 extends in the stacking direction of the discharge electrodes 6012, and has a plurality of slots 6148 into which the side ends of the respective discharge electrodes 6012 are inserted. The reinforcement protrusions 6125 and the reinforcement plates 6126 are inserted into the first setting beam 6014. The reinforcement plates 6126 are installed to pass through the first setting beam 6014, and the lower ends of the reinforcement plates 6126 are supported by the first setting beam 6014.

The first setting beam 6014 includes a bottom plate 6141 formed in parallel to the ground, a lower sidewall 6142 extending upward from the bottom plate 6141, an intermediate support 6143 extending laterally from the lower sidewall 6142, a bent plate 6144 bent from the intermediate support 6143 to face the intermediate support 6143, an upper sidewall 6145 extending upward from the bent plate 6144, and an upper support jaw 6146 bent toward the discharge electrodes 6012 from the upper sidewall 6145. The slots 6148 are formed in the upper support jaw 6146, and the lower ends of the reinforcement plates 6126 are mounted on the intermediate support 6143. The bent plate 6144 has a smaller width than the intermediate support 6143, and the intermediate support 6143 has a portion facing the bent plate 6144 and a portion facing the upper support jaw 6146.

The upper sidewall 6145 is formed in parallel to the lower sidewall 6142 and disposed at a distance from the lower sidewall 6142. Meanwhile, one portion of the side end of each reinforcement protrusion 6125 further protrudes from the other portion thereof, and the upper and lower sidewalls 6145 and 6142 may be coupled to abut on the respective portions of the side end of the reinforcement protrusion 6125.

Each reinforcement plate 6126 may be made of the same material as the first setting beam 6014 and may be thicker than the discharge electrode 6012. Thus, the reinforcement plate 6126 may be easily welded to the first setting beam 6014. The discharge electrode 6012 should have a small thickness and an excellent electrical conductivity, but it may be difficult to weld the discharge electrode high in conductivity and thin in thickness. However, according to the sixth exemplary embodiment, the reinforcement plate installed on the discharge electrode 6012 enables the discharge electrode 6012 to be easily welded to the first setting beam 6014.

Figure 31:
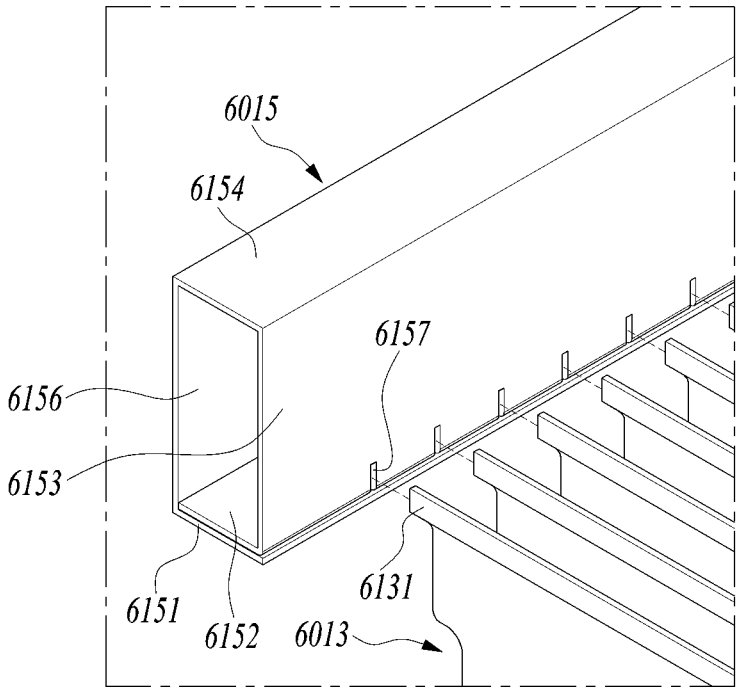
FIG. 31 is an exploded perspective view partially illustrating one second setting beam and collection electrodes according to the sixth exemplary embodiment.

FIG. 31 is an exploded perspective view partially illustrating one second setting beam and collection electrodes according to the sixth exemplary embodiment.

Referring to FIG. 31, each of the second setting beams 6015 extends in the stacking direction of the collection electrodes 6013, and has a plurality of slots 6157 into which the side ends of the respective collection electrodes 6013 are inserted. The slots 6157 are spaced apart from each other in the longitudinal direction of the second setting beam 6015.

The reinforcement rods 6131 are fixed to the respective upper and lower ends of each collection electrode 6013, and the reinforcement rods 6131 are inserted into the second setting beam 6015. The reinforcement rods 6131 are installed to pass through the second setting beam 6015, and the lower ends of the reinforcement rods 6131 are supported by the second setting beam 6015.

The second setting beam 6015 includes a lower plate 6152, a first side plate 6153 bent and extending upward from the lower plate 6152, an upper plate 6154 bent from the first side plate 6153 to face the lower plate 6152, a second side plate 6156 bent from the upper plate 6154 to face the first side plate 6153, and a bottom support 6151 bent from the second side plate 6156 to be disposed beneath the lower plate 6152. Each of the reinforcement rods 6131 is inserted into the lower plate 6152 and the first side plate 6153, and the lower end of the reinforcement rod 6131 is abutted and mounted on the upper surface of the bottom support 6151. The reinforcement rod 6131 may be fixed to the second setting beam 6015 by welding. As illustrated in FIG. 23, the second setting beam 6015 may be fixed to the inner wall of the housing 6200 through a supporting bracket 6530. The supporting brackets 6530 may be fixed to the housing 6200 and each be made of a nonconductor.

As described above, in the collection module 6100 according to the sixth exemplary embodiment, the first and second tie rods 6016 and 6017 and the first and second setting beams 6014 and 6015 may stably fix the discharge and collection electrodes 6012 and 6013 while maintaining the distance therebetween.

Figure 32:
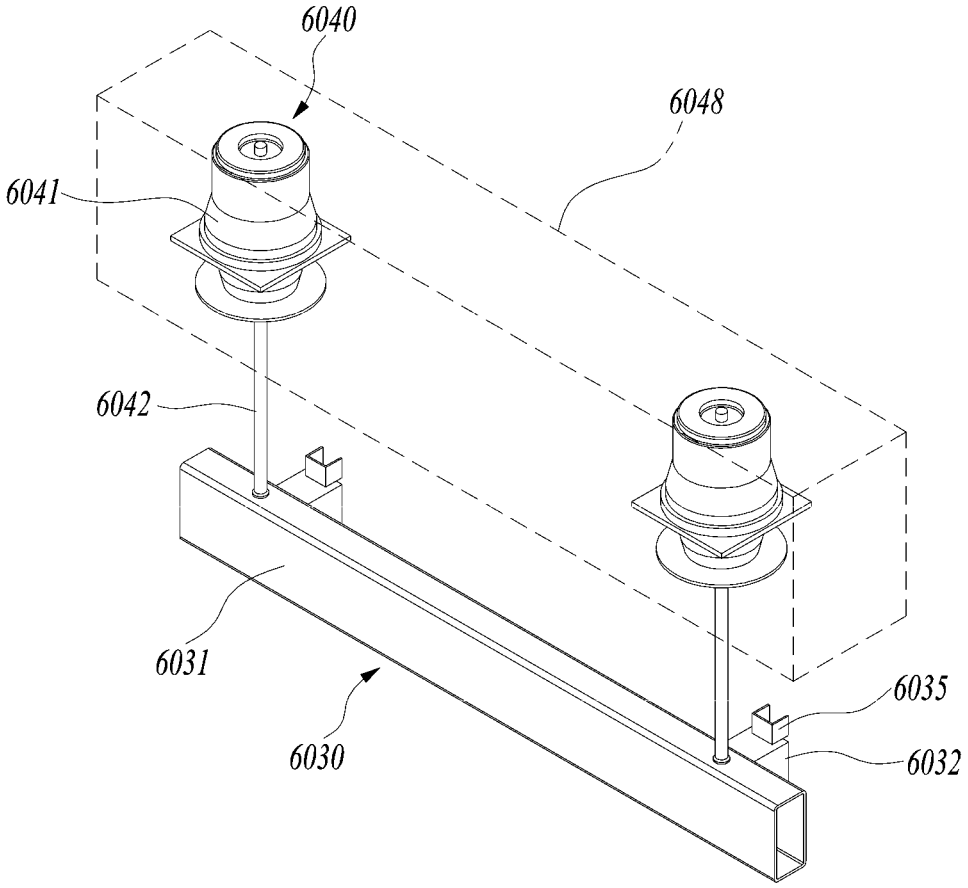
FIG. 32 is a perspective view illustrating insulating connection members, a tubular girder, and one lower frame according to the sixth exemplary embodiment.
Figure 33:
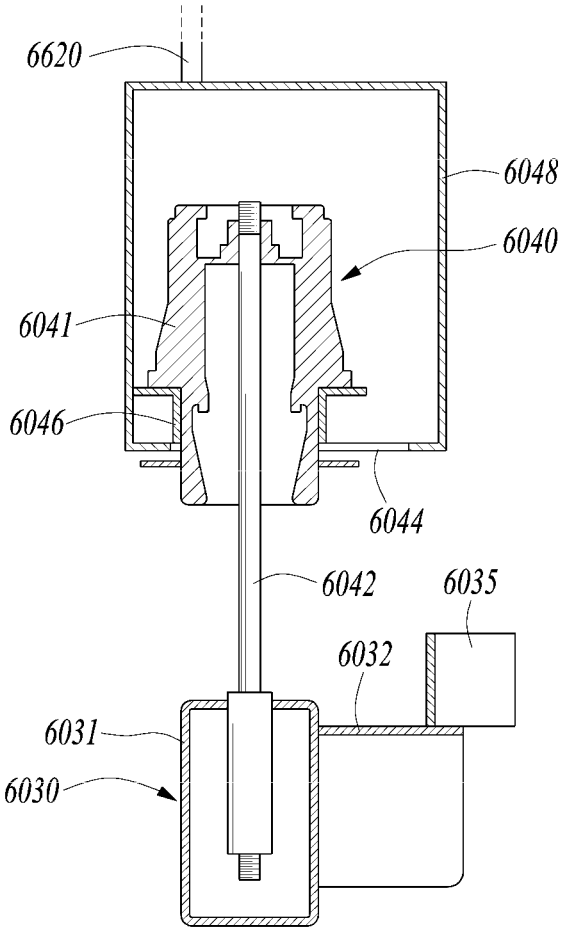
FIG. 33 is a cross-sectional view illustrating one insulating connection member and one lower frame according to the sixth exemplary embodiment.

FIG. 32 is a perspective view illustrating the insulating connection members, the tubular girder, and one lower frame according to the sixth exemplary embodiment. FIG. 33 is a cross-sectional view illustrating one insulating connection member and one lower frame according to the sixth exemplary embodiment.

Referring to FIGS. 29, 32, and 33, each of the lower frames 6030 extends in the stacking direction of the discharge and collection electrodes 6012 and 6013. Any one of the lower frames 6030 is supported by the insulating connection members 6040. Two lower frames 6030 may be installed to one collection module 6100 and fixed to each other by two connection rods 6036.

Each of the lower frames 6030 includes a lower pipe 6031 having a substantially tubular shape, a plurality of protruding frames 6032 protruding laterally from the lower pipe 6031, and mounting frames 6035 protruding laterally and upward from the respective protruding frames 6032. The lower pipe 6031 may be a pipe having a square cross-section. The protruding frames 6032 may be fixed to the side of the lower pipe and each include a top plate and two side plates bent downward from the top plate. The mounting frames 6035 are coupled to an associated one of the first setting beams 6014 to support the first setting beam 6014. The mounting frames 6035 are inserted between the bottom plate 6141 and the intermediate support 6143 and coupled to the first setting beam 6014. The mounting frames 6035 of the lower frame 6030 may be two. Meanwhile, the lower frame 6030 is charged to a high voltage, and the first setting beam 6014 and the discharge electrode 6012 are also charged to a high voltage through the lower frame 6030. Here, the charging voltage of the discharge electrode 6012 may be 25,000 to 75,000 V.

The uppermost one of the lower frames 6030 is provided with the insulating connection members 6040 and charged to a high voltage. The lower frame 6030 disposed beneath the uppermost lower frame 6030 may be charged through the connection rods 6036. Each of the insulating connection members 6040 includes a terminal rod 6042 configured to apply a high voltage to the discharge electrode 6012, and a lower insulator 6041 for insulation. The insulating connection member 6040 may have a hole formed in the lower portion thereof for downward injection of air, and the terminal rod 6042 is fixed to the lower frame 6030 by protruding downward through the hole. An anchor (not illustrated) is installed to the terminal rod 6042 to support the lower frame 6030.

Thus, a high voltage is applied to the discharge electrode 6012 through the lower frame 6030 and the first setting beam 6014. In addition, the lower frame 6030 is suspended from the insulating connection member 6040.

The insulating connection members 6040 are inserted into the tubular girder 6048 having an internal space, and the tubular girder 6048 extends in the same direction as the lower frame 6030. The tubular girder 6048 may be fixed to the inner wall of the housing 6200, and the air supply pipe 6620 may be installed on the tubular girder 6048. The tubular girder 6048 may have a discharge hole 6044 formed in the lower portion thereof for discharge of purge air.

The tubular girder 6048 has a mount 6046 installed therein to support the lower insulator 6041, and the lower insulator 6041 is placed on the mount 6046. A power supply is connected to the insulating connection member 6040 to apply a high voltage thereto, and the terminal rod 6042 is insulated and fixed to the tubular girder 6048 through the lower insulator 6041. The terminal rod 6042 may pass through the center of the lower insulator 6041, and a power supply line may be connected to the upper end of the terminal rod 6042. Thus, the terminal rod 6042 may be charged to a high voltage and the tubular girder 6048 may be grounded.

Figure 34:
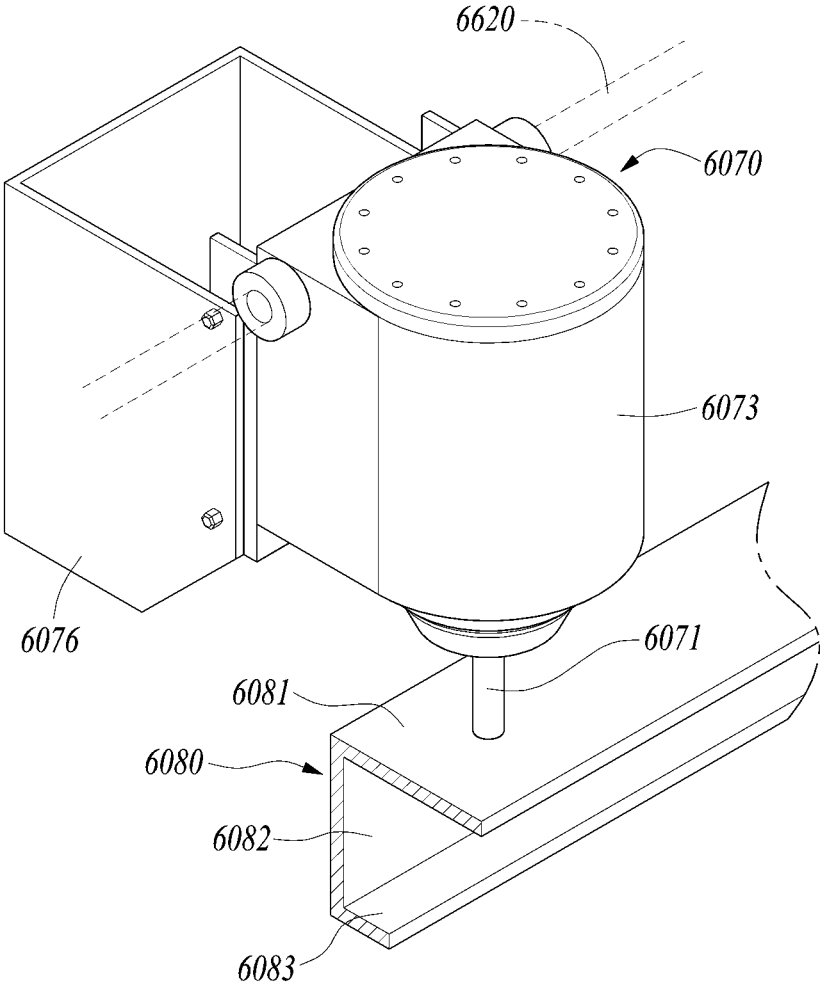
FIG. 34 is a perspective view illustrating one prestress locking member according to the sixth exemplary embodiment.
Figure 35:
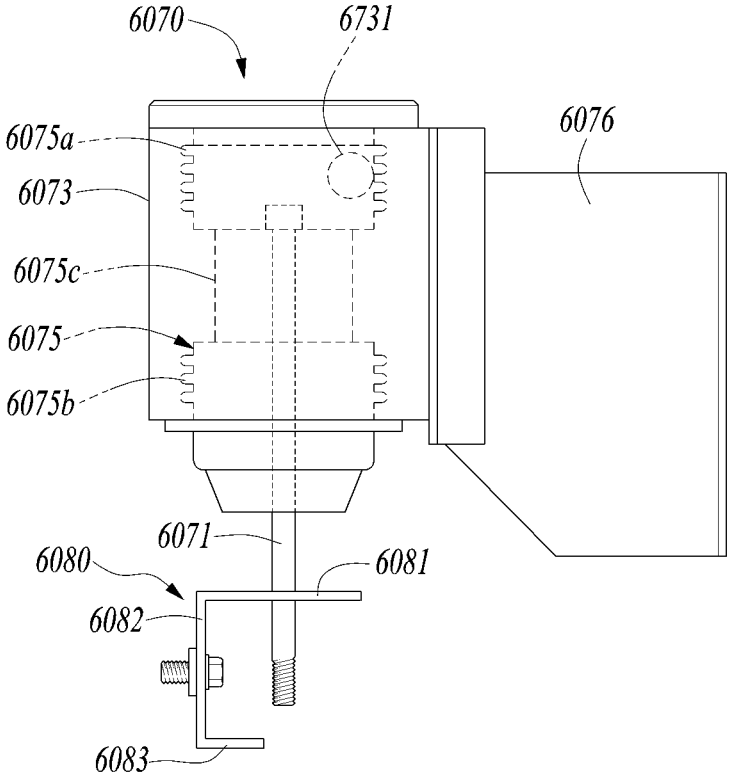
FIG. 35 is a side view illustrating the prestress locking member according to the sixth exemplary embodiment.

FIG. 34 is a perspective view illustrating one prestress locking member according to the sixth exemplary embodiment. FIG. 35 is a side view illustrating the prestress locking member according to the sixth exemplary embodiment.

Referring to FIGS. 34 and 35, each of the prestress locking members 6070 is fixed to the inner wall of the housing 6200, and includes a casing 6073, an insulator 6075 installed in the casing 6073, and a pressure rod 6071 coupled to the insulator 6075. Two prestress locking members 6070 may be installed on one side of the collection module 6100. One of the two prestress locking members 6070 may be disposed at the upper portion of the side of the collection module 6100 and the other prestress locking member 6070 may be disposed at the lower portion of the side of the collection module 6100.

The casing 6073 is cylindrical and has an internal space, and a bracket 6076 is installed to one side of the casing 6073 to fix the casing 6073 to the housing 6200. The casing 6073 may be provided with an air inlet 6731 and the air supply pipe 6620 may be connected to the air inlet 6731. The purge air introduced into the casing 6073 prevents a short circuit due to moisture while the purge air is discharged downward.

The insulator 6075 may include an upper insulator 6075*a* fixed to the upper portion of the casing 6073, a lower insulator 6075*b* fixed to the lower portion of the casing 6073, and an insulating tube 6075*c* connecting the upper insulator 6075*a* and the lower insulator 6075*b*. The pressure rod 6071 is fixed to the insulator 6075 and protrudes downward of the prestress locking member 6070.

The pressure rod 6071 is coupled to an associated one of the collection electrode support beams 6080, and the prestress locking member 6070 is installed to press the collection electrode support beam 6080 in a central direction. The collection electrode support beams 6080 are disposed at the respective outermost sides of the stacked collection electrodes 6013 and extend in the width direction of the collection electrodes 6013. The plurality of collection electrode support beams 6080 coupled to the second tie rods 6017 may be installed on the side ends of the collection module 6100, and the above two prestress locking members 6070 may be coupled to two of the collection electrode support beams 6080.

Each of the collection electrode support beams 6080 includes an upper support plate 6081, a side support plate 6082 bent and extending downward from the upper support plate 6081, and a lower support plate 6083 bent from the side support plate 6082 to be disposed in parallel to the upper support plate 6081. The second tie rods 6017 may be coupled to the side support plate 6082. The lower support plate 6083 has a smaller width than the upper support plate 6081.

When the collection electrode support beam 6080 is installed in the state in which it is pressed by the prestress locking member 6070, it is possible to effectively reduce the vibration of the collection module 6100.

As is apparent from the above description, according to the exemplary embodiments, since the washing water treatment device includes the belt, the roller, and the scraper, the service life of the washing water can be increased by adsorbing dust on the belt and sinking solidified dust to the bottom of the reservoir.

While the specific embodiments have been described with reference to the drawings, the disclosure is not limited thereto. It will be apparent to those skilled in the art that various changes and modifications may be made without departing from the spirit and scope of the disclosure as defined in the following claims.

What is claimed is:

1. An electrostatic precipitator apparatus comprising:

a housing having an inlet, into which gas is introduced, and an outlet from which the gas is discharged;

a collection module installed in the housing and comprising a plurality of discharge electrodes, to which a voltage is applied, and a plurality of collection electrodes disposed between the plurality of discharge electrodes, the plurality of collection electrodes coupled to a ground;

a washing water feeder configured to spray washing water to the collection module; and a washing water treatment device disposed beneath the collection module to accommodate the washing water dropped from the collection module, the washing water treatment device comprising:

a reservoir configured to accommodate the washing water;

an adsorption belt in an endless-track form;

a roller connected to the adsorption belt to move the adsorption belt; and a scraper configured to scrape off dust attached on the adsorption belt to separate the dust from the adsorption belt.

2. The electrostatic precipitator apparatus according to claim 1, wherein the adsorption belt is in a mesh form.

3. The electrostatic precipitator apparatus according to claim 1, wherein a portion of the adsorption belt is submerged in the washing water and the other portion of the adsorption belt is positioned above the washing water.

4. The electrostatic precipitator apparatus according to claim 1, wherein the scraper is installed vertically on the bottom of the reservoir and a mass of dust separated from the adsorption belt is accumulated on the bottom of the reservoir.

5. The electrostatic precipitator apparatus according to claim 4, wherein the scraper comprises a support rod installed vertically on the bottom of the reservoir and an elastic tip protruding upward from the support rod.

6. The electrostatic precipitator apparatus according to claim 1, wherein the adsorption belt protrudes outward from the housing, the scraper is installed outside the housing, and a dust separation container is installed beneath the scraper to accommodate the dust separated from the adsorption belt.

7. The electrostatic precipitator apparatus according to claim 1, wherein: the housing is provided therein with a blocking member configured to separate a space, in which the collection module is installed, from a space in which the washing water treatment device is installed; and the blocking member comprises a plurality of blocking plates and rotary columns coupled to the respective blocking plates, and is rotatably installed in the housing.

8. The electrostatic precipitator apparatus according to claim 1, wherein the electrostatic precipitator apparatus is a platform electrostatic precipitator apparatus installed between platforms, and guide vanes are installed in the respective inlet and outlet to guide inflow and outflow of air.

9. The electrostatic precipitator apparatus according to claim 8, wherein the housing is installed between two neighboring rails so that the air is introduced into and discharged from the housing by means of wind generated when a train moves.

10. The electrostatic precipitator apparatus according to claim 8, further comprising a controller connected to the guide vanes to control rotation of the guide vanes, wherein when a train approaches toward the inlet, the controller, based on the direction of movement of the train, controls an outer end of the guide vane, installed in the inlet, to face rearward while controlling an outer end of the guide vane, installed in the outlet, to face forward.

11. The electrostatic precipitator apparatus according to claim 1, wherein the scraper comprises a rotary rod and a plurality of paddles protruding from an outer peripheral surface of the rotary rod, the paddles being spaced apart from each other in a circumferential direction of the rotary rod.

12. The electrostatic precipitator apparatus according to claim 1, wherein: the washing water treatment device comprises two support rollers and first and second diversion rollers disposed between the support rollers, the first diversion roller being configured to support a lower end of the adsorption belt to move upward, the second division roller being configured to support the lower end of the adsorption belt to move downward; and a blocking wall is installed in the reservoir to separate a space, in which the scraper is present, from a remaining space.

13. The electrostatic precipitator apparatus according to claim 12, wherein the first diversion roller supports the adsorption belt to be positioned above an upper end of the blocking wall, and the second diversion roller supports the adsorption belt to be positioned beneath the upper end of the blocking wall.

14. The electrostatic precipitator apparatus according to claim 13, wherein the scraper abuts on the adsorption belt between the second diversion roller and an associated one of the support rollers.

* * * * *